US012251072B2

(12) United States Patent
Xu et al.

(10) Patent No.: US 12,251,072 B2
(45) Date of Patent: Mar. 18, 2025

(54) SCRUBBER BRUSH ASSEMBLY AND VACUUM CLEANER HAVING SAME

(71) Applicants: JIANGSU MIDEA CLEANING APPLIANCES CO., LTD., Suzhou (CN); MIDEA GROUP CO., LTD., Foshan (CN)

(72) Inventors: Xia Xu, Suzhou (CN); Tom Ford, Suzhou (CN); Xuebing Yin, Suzhou (CN)

(73) Assignees: JIANGSU MIDEA CLEANING APPLIANCES CO., LTD., Suzhou (CN); MIDEA GROUP CO., LTD., Foshan (CN)

( * ) Notice: Subject to any disclaimer, the term of this patent is extended or adjusted under 35 U.S.C. 154(b) by 223 days.

(21) Appl. No.: 17/790,738

(22) PCT Filed: Jan. 4, 2021

(86) PCT No.: PCT/CN2021/070086
§ 371 (c)(1),
(2) Date: Jul. 4, 2022

(87) PCT Pub. No.: WO2021/139616
PCT Pub. Date: Jul. 15, 2021

(65) Prior Publication Data

US 2023/0051802 A1 Feb. 16, 2023

(30) Foreign Application Priority Data

Jan. 7, 2020 (CN) ..... 202020028296.9
Jan. 7, 2020 (CN) ..... 202020028392.3
(Continued)

(51) Int. Cl.
*A47L 9/04* (2006.01)

(52) U.S. Cl.
CPC ..... *A47L 9/0477* (2013.01); *A47L 9/0411* (2013.01); *A47L 9/0433* (2013.01); *A47L 9/0444* (2013.01)

(58) Field of Classification Search
CPC .... A47L 9/0477; A47L 9/0411; A47L 9/0433; A47L 9/0444; A46B 13/005; A46B 17/06
See application file for complete search history.

(56) References Cited

U.S. PATENT DOCUMENTS

2016/0058256 A1 3/2016 Ju et al.

FOREIGN PATENT DOCUMENTS

CA 2890795 A1 11/2015
CN 202154637 U 3/2012
(Continued)

OTHER PUBLICATIONS

ISR mailed Apr. 12, 2021 for PCT Application No. PCT/CN2021/070086.

(Continued)

*Primary Examiner* — David Redding

(57) ABSTRACT

Provided are a scrubber brush assembly and a vacuum cleaner having same. The scrubber brush assembly includes a roller brush body and a scraping sleeve. The roller brush body is rotatable around a first rotation center line and has a bristle (12) provided thereon. The scraping sleeve is rotatable around a second rotation center line noncoincident with the first rotation center line and sleeved over the roller brush body. The scraping sleeve has a scraping sleeve hole defined thereon. The bristle is adapted to be extended out of or retracted into the scraping sleeve hole in a wall thickness direction of the scraping sleeve.

18 Claims, 17 Drawing Sheets

(30) Foreign Application Priority Data

Jan. 7, 2020 (CN) ..... 202020028445.1
Jan. 7, 2020 (CN) ..... 202020028762.3
Jan. 7, 2020 (CN) ..... 202020028954.4

(56) References Cited

FOREIGN PATENT DOCUMENTS

| | | | |
|---|---|---|---|
| CN | 206214015 | U | 6/2017 |
| CN | 107874704 | A | 4/2018 |
| CN | 108158520 | A | 6/2018 |
| CN | 108201413 | A | 6/2018 |
| CN | 108294705 | A | 7/2018 |
| CN | 108371523 | A | 8/2018 |
| CN | 108464771 | A | 8/2018 |
| CN | 208435473 | U | 1/2019 |
| CN | 208659159 | U | 3/2019 |
| CN | 211704444 | U | 10/2020 |
| CN | 211704445 | U | 10/2020 |
| CN | 211796206 | U | 10/2020 |
| CN | 211796207 | U | 10/2020 |
| CN | 211961925 | U | 11/2020 |
| CN | 212015458 | U | 11/2020 |
| DE | 102017109595 | A1 | 11/2018 |
| JP | 2005066034 | A | 3/2005 |
| JP | 3199039 | U | 8/2015 |
| JP | 5887018 | B2 | 3/2016 |
| JP | 2016168467 | A | 9/2016 |
| JP | 2018057617 | A | 4/2018 |
| WO | 2009124278 | A1 | 10/2009 |

OTHER PUBLICATIONS

First OA Received in CN Application No. 202010014923.8; mailed Nov. 29, 2024.
First OA Received in CN Application No. 202010015108.3; mailed Nov. 29, 2024.
First OA Received in CN Application No. 202010015203.3; mailed Nov. 29, 2024.
First OA Received in CN Application No. 202010015213.7; mailed Nov. 29, 2024.
Zhang Yaodong et al., "Outdoor Cleaning Device—Design of "Ground Cleaner"", Modern Economic Information, Issue 08, Apr. 25, 2019, Full text.
Jin Tong et al., "The 3D Design of Corridor Sweeping Machine", Modern Manufacturing Technology and Equipment, Issue 01, Jan. 15, 2008, Full text.
Sun Xiaoming; Wang Qingbo;, "Airflow Roller Brush Snow Remover", Gansu Science and Technology, Issue 02, Jan. 23, 2008, Full text.
Huang Guangron, "Casting Technology of Buried Pipe Water-Colled Furnace Mouth", Foundry Issue 03, Mar. 22, 1995, Full text.
Zhang Shebei et al., "Discused Shalowly the Static Excitation System Produces the Axis Voltage to Protect", Journal of Henan Electromechanical College, Issue 01, Jan. 30, 2007, Full text.
Wu Xuemei et al., "Design and experiment of roller-spreading device for tobacco leaves", Issue 07, Jul. 15, 2016, Full text.
Shi Chengyin et al. "The Mechanism of Intelligent Roller Type Robot Blackboard Eraser" Issue 17, Sep. 15, 2017, Full text.

SCRUBBER BRUSH ASSEMBLY AND VACUUM CLEANER HAVING SAME

CROSS-REFERENCES TO RELATED APPLICATIONS

The present disclosure is a national phase application of International Application No. PCT/CN2021/070086, filed on Jan. 4, 2021, which claims priority to Chinese Patent Applications No. 202020028392.3, No. 202020028954.4, No. 202020028296.9, No. 202020028445.1, and No. 202020028762.3 that are filed on Jan. 7, 2020, the entire disclosures of which are incorporated herein by reference.

FIELD

The present disclosure relates to the field of household appliance technologies, and more particularly, to a scrubber brush assembly and a vacuum cleaner.

BACKGROUND

In the related art, during an operation of a vacuum cleaner, hairs are easily attached to or entangled with bristles of the vacuum cleaner. On the one hand, the hairs are difficult to be cleaned. On the other hand, long-term accumulation of the hairs may result in a reduction in cleaning efficiency of the vacuum cleaner or even damages thereto.

SUMMARY

The present disclosure aims to solve at least one of the problems in the related art. To this end, the present disclosure provides a scrubber brush assembly that is capable of automatically cleaning hairs attached to bristles.

In a first aspect of the present disclosure, a scrubber brush assembly includes: a roller brush body rotatable around a first rotation center line extending in a horizontal direction and having a bristle provided thereon, the bristle extending in a radial direction of the roller brush body; and a scraping sleeve rotatable around a second rotation center line and sleeved over the roller brush body. The second rotation center line extends in the horizontal direction and is non-coincident with the first rotation center line. The scraping sleeve has a scraping sleeve hole defined thereon and penetrating the scraping sleeve in a wall thickness direction of the scraping sleeve. An inside of the scraping sleeve hole is opposite to an outside of the bristle, and the bristle is adapted to be extended out of and retracted into the scraping sleeve hole in the wall thickness direction of the scraping sleeve.

With the scrubber brush assembly according to an embodiment of the present disclosure, by arranging the roller brush body eccentrically with respect to the scraping sleeve, the bristle on the roller brush body can be extended out of or retracted into the scraping sleeve hole in a through hole direction of the scraping sleeve hole on the scraping sleeve when the roller brush body and the scraping sleeve rotate. During retracting the bristle into the scraping sleeve hole, hairs attached to the bristle can be automatically cleaned by the scraping sleeve hole and sucked away by the vacuum cleaner. Therefore, the vacuum cleaner can automatically clean the hairs during its operation, which eliminates a need for manual cleaning and enhances user-friendliness of a design of the vacuum cleaner, to prevent a reduction in cleaning efficiency due to hair blockage.

According to an example of the present disclosure, in the radial direction of the roller brush body, a distance between a free end of the bristle and the first rotation center line is equal to or greater than a maximum distance between the first rotation center line and an inner peripheral wall of the scraping sleeve.

According to an example of the present disclosure, the scraping sleeve hole includes: a first hole portion in a circular shape; and a second hole portion connected to and extending away from the first hole portion in a circumferential direction of the scraping sleeve. A width of the second hole portion in an axial direction of the scraping sleeve is smaller than a diameter of the first hole portion.

According to an example of the present disclosure, the scrubber brush assembly also includes a housing having an accommodation space defined therein. An inner surface of the housing at a position corresponding to the accommodation space is at least partially formed as a cylindrical surface extending in the horizontal direction. The roller brush body and the scraping sleeve are disposed in the housing. The first rotation center line of the roller brush body is eccentrically arranged with respect to a center axis of a circumferential wall of the cylindrical surface of the accommodation space. The second rotation center line of the scraping sleeve is coincident with the center axis of the circumferential wall of the cylindrical surface of the accommodation space. The bristle is adapted to be extended out of or retracted into the scraping sleeve hole in the wall thickness direction of the scraping sleeve when the roller brush body and the scraping sleeve rotate.

According to an example of the present disclosure, the scrubber brush assembly also includes a housing having an accommodation space defined therein. An inner surface of the housing at a position corresponding to the accommodation space being at least partially formed as a cylindrical surface extending in the horizontal direction. The roller brush body and the scraping sleeve are disposed in the housing. The first rotation center line of the roller brush body is coincident with a center axis of a circumferential wall of the cylindrical surface of the accommodation space, and the second rotation center line of the scraping sleeve is eccentrically arranged with respect to the center axis of the circumferential wall of the cylindrical surface of the accommodation space. The bristle is adapted to be extended out of or retracted into the scraping sleeve hole in the wall thickness direction of the scraping sleeve when the roller brush body and the scraping sleeve rotate.

According to an example of the present disclosure, the housing has a dust suction inlet and a dust suction outlet that are defined thereon and in communication with the accommodation space. In a circumferential direction of the roller brush body, the bristle at a position corresponding to the dust suction inlet is capable of being extended out of the scraping sleeve hole by a longest length.

According to an example of the present disclosure, the scrubber brush assembly also includes a first driving device connected to the roller brush body and the scraping sleeve to drive the roller brush body and the scraping sleeve to rotate. The bristle is adapted to be extended out of or retracted into the scraping sleeve hole in a radial direction of the scraping sleeve when the roller brush body and the scraping sleeve rotate.

According to an example of the present disclosure, the first driving device includes: a first driving motor having a first driving shaft; a first driving gear coaxially fixed with the first driving shaft; a first transmission assembly connected between the first driving gear and the scraping sleeve in a transmission manner; and a second transmission assembly connected between the first driving gear and the roller brush body in a transmission manner.

According to an example of the present disclosure, the first transmission assembly includes a first transmission gear connected to the scraping sleeve, and a driving belt tensioned between the first driving gear and the first transmission gear.

According to an example of the present disclosure, the second transmission assembly includes a second transmission gear connected to the roller brush body, and a second driving belt tensioned between the first driving gear and the second transmission gear.

According to an example of the present disclosure, the second transmission gear includes: an engagement ring plate in a cylindric shape extending axially and having a second transmission tooth portion formed on an outer surface thereof, the second transmission tooth portion being in a transmission engagement with the second driving belt; a connection sleeve in a cylindric shape extending in an axial direction of the roller brush body and located at an inner side of the engagement ring plate, an end of the connection sleeve facing towards the roller brush body being connected to the roller brush body; and a radial plate extending in the radial direction of the roller brush body and connected to each of the engagement ring plate and the connection sleeve.

According to an example of the present disclosure, the scrubber brush assembly also includes a second driving device connected to one of the roller brush body and the scraping sleeve. The one of the roller brush body and the scraping sleeve is in a transmission connection with the other of the roller brush body and the scraping sleeve. The bristle is adapted to be extended out of or retracted into the scraping sleeve hole in a radial direction of the scraping sleeve when the roller brush body and the scraping sleeve rotate.

According to an example of the present disclosure, the second driving device includes a second driving motor having a second driving shaft, and a transmission assembly connected between the second driving shaft and the scraping sleeve.

According to an example of the present disclosure, the second driving device also includes a second driving gear coaxially fixed with the second driving shaft. The transmission assembly includes a third transmission gear connected to the scraping sleeve, and a third driving belt tensioned between the second driving gear and the third transmission gear.

According to an example of the present disclosure, the transmission assembly also includes a transmission member in a hollow ring shape extending in an axial direction of the scraping sleeve. The transmission member has one end connected to the third transmission gear and another end fixed relative to the scraping sleeve.

According to an example of the present disclosure, the transmission member includes: an outer ring plate in a cylindric shape extending in the axial direction of the scraping sleeve, the outer ring plate having an axial end fixed to the third transmission gear and another axial end fixed to the scraping sleeve; an inner ring plate in a cylindric shape extending in the axial direction of the scraping sleeve, the inner ring plate being located at a radial inner side of the outer ring plate; and a connection plate connected between an inner wall surface of the outer ring plate and an outer wall surface of the inner ring plate.

According to an example of the present disclosure, the transmission assembly also includes a fourth transmission gear fixedly connected to the roller brush body, and a fifth transmission gear engaged with the fourth transmission gear and fixed relative to the inner ring plate.

According to an example of the present disclosure, the fifth transmission gear has a first engagement portion formed thereon. The first engagement portion is formed as an inner tooth and engaged with the fourth transmission gear.

According to an example of the present disclosure, the fifth transmission gear also has a second engagement portion formed thereon. The second engagement portion is axially spaced apart from the first engagement portion and formed into an inner tooth. The inner ring plate has a third engagement portion disposed on the outer wall surface thereof and engaged with the second engagement portion.

In a second aspect of the present disclosure, a vacuum cleaner includes the scrubber brush assembly in the first aspect of the present disclosure.

With the vacuum cleaner according to the present disclosure, by providing the scrubber brush assembly in the first aspect, hairs attached to the bristle can be cleaned automatically, which eliminates a need for manual cleaning and makes the vacuum cleaner more user-friendly, to enhance cleaning efficiency of the vacuum cleaner.

Embodiments of the present disclosure will be provided at least in part in the following description, or will become apparent at least in part from the following description, or can be learned from practicing of the present disclosure.

Figure 1:
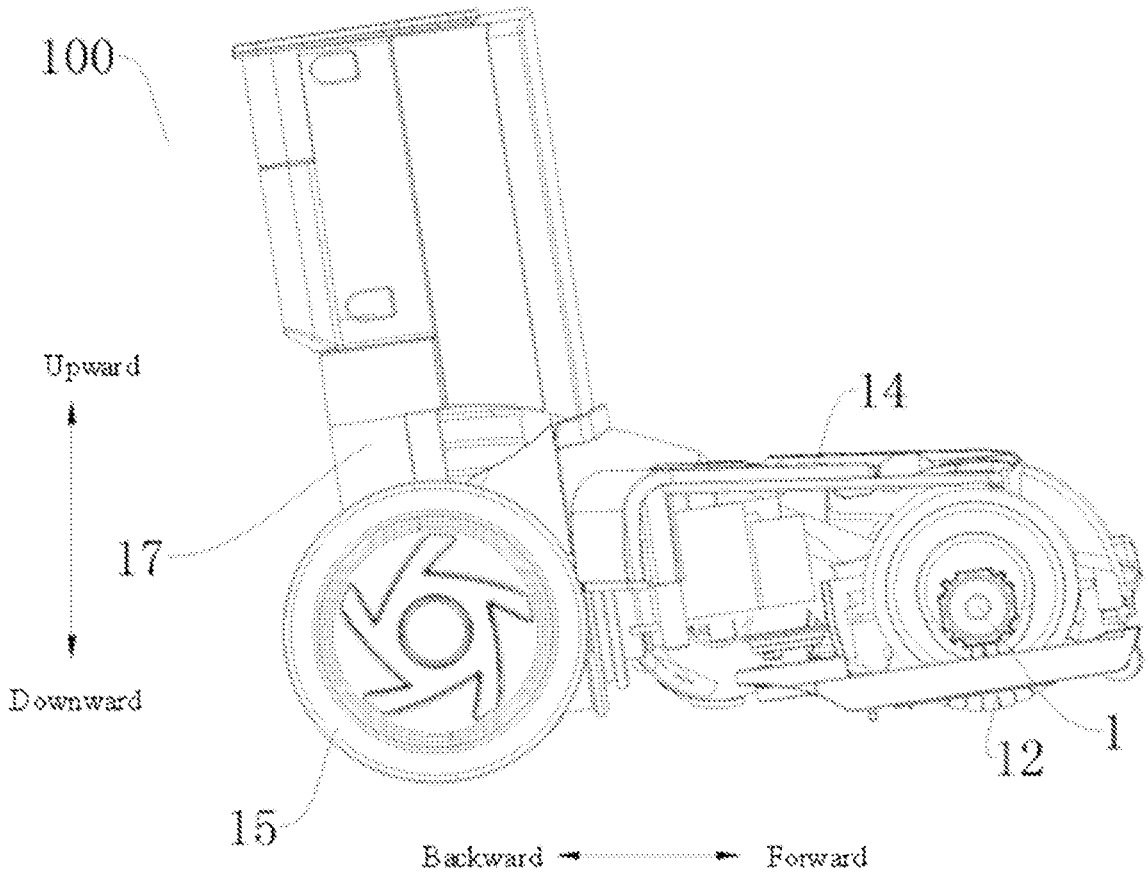
FIG. 1 is a schematic view of a vacuum cleaner according to an embodiment of the present disclosure.
Figure 2:
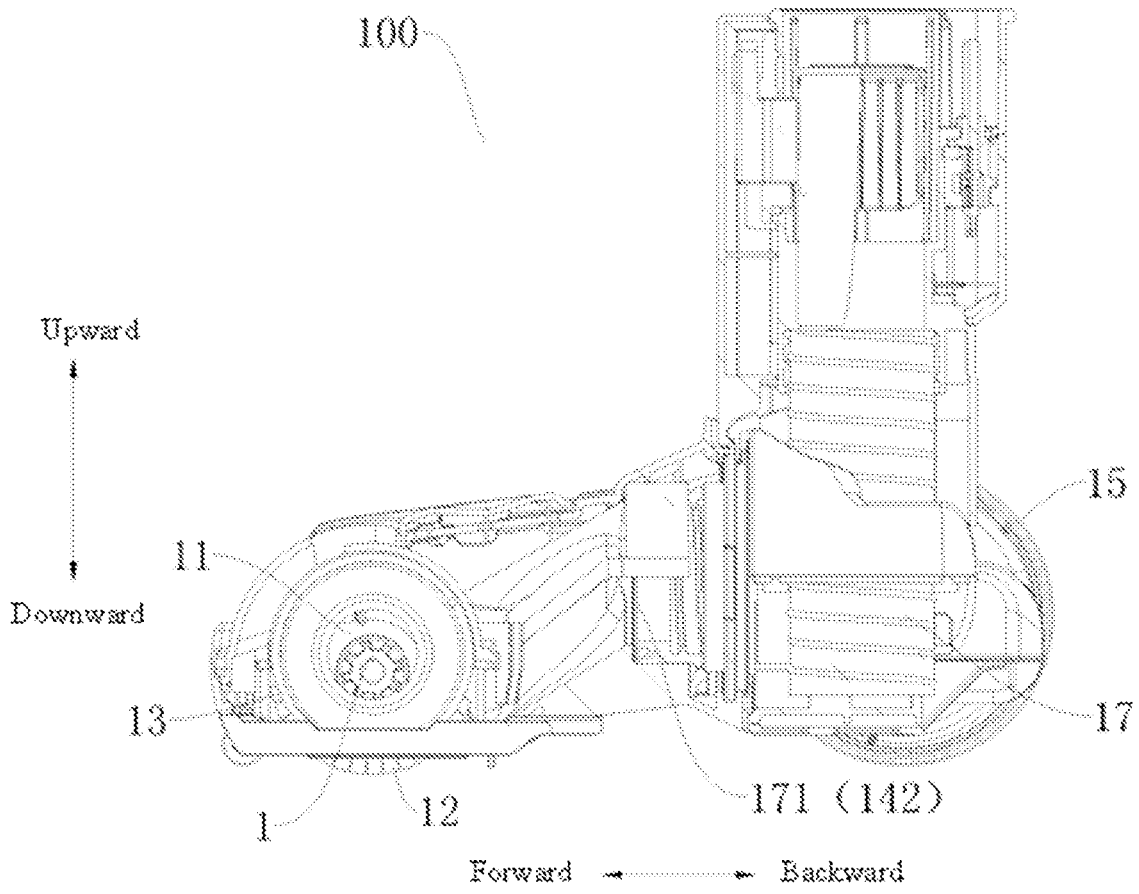
FIG. 2 is a sectional view of a vacuum cleaner illustrated in FIG. 1.
Figure 3:
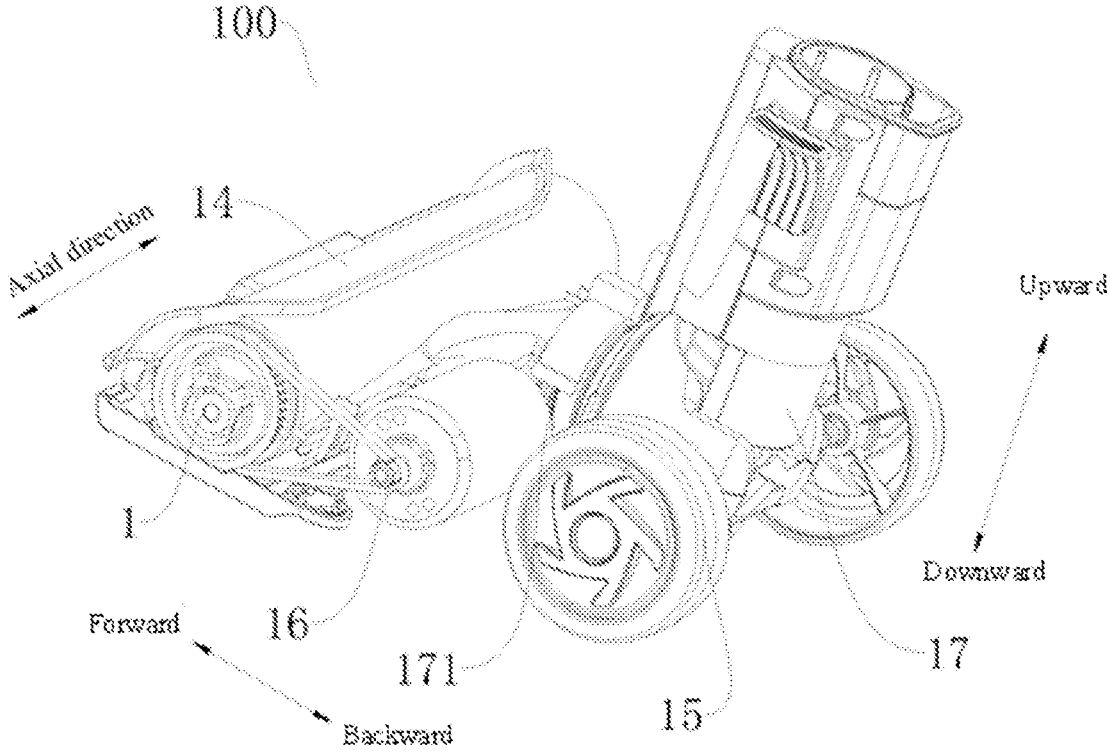
FIG. 3 is a schematic partial view of the vacuum cleaner illustrated in FIG. 1 from another view.

REFERENCE SIGNS vacuum cleaner 100:
scrubber brush assembly 1,
roller brush body 11, first roller brush body segment 111, second roller brush body segment 112, protruding rib 1111,
bristle 12,
scraping sleeve 13,
first scraping sleeve segment 131, scraping sleeve hole 1311, first hole portion 13111, second hole portion 13112, first circumferential positioning portion 1312,
second scraping sleeve segment 132, second circumferential positioning portion 1321,
housing 14, dust suction inlet 141, dust suction outlet 142,
roller wheel 15,
dust suction cavity 17, connection port 171,
first driving device 16,
first driving motor 18, first driving gear 181,
first transmission gear 19, first transmission ring 191, first transmission tooth portion 1911, first connection ring 192,
first driving belt 20, second transmission gear 21, engagement ring plate 211, second transmission tooth portion 2111, connection sleeve 212, second driving belt 22, compression ring 23,
second driving motor 31, second driving gear 32, third transmission gear 331, third driving belt 332,
transmission member 333, outer ring plate 3331, inner ring plate 3332, third engagement portion 33321, connection plate 3333,
fourth transmission gear 334, fifth transmission gear 335, first engagement portion 3351, second engagement portion 3352.

DETAILED DESCRIPTION OF THE DISCLOSURE

The embodiments of the present disclosure will be described in detail below with reference to examples thereof as illustrated in the accompanying drawings, throughout which same or similar elements, or elements having same or similar functions, are denoted by same or similar reference numerals. The embodiments described below with reference to the accompanying drawings are illustrative only, and are intended to explain, rather than limiting the present disclosure.

A scrubber brush assembly 1 according to an embodiment in a first aspect of the present disclosure will be described below with reference to the accompanying drawings.

According to an embodiment in the first aspect of the present disclosure, the scrubber brush assembly 1 includes a roller brush body 11 and a scraping sleeve 13.

In an embodiment, in connection with FIG. 5 to FIG. 10, the roller brush body 11 has a first rotation center line extending horizontally. The roller brush body 11 is rotatable around the first rotation center line, and has a bristle 12 provided thereon and extending in a radial direction of the roller brush body 11. The scraping sleeve 13 has a second rotation center line extending horizontally, and is rotatable around the second rotation center line. The first rotation center line is non-coincident with the second rotation center line. That is, the roller brush body 11 is eccentrically arranged with respect to the scraping sleeve 13. Here, the scraping sleeve 13 is sleeved over the roller brush body 11. The scraping sleeve 13 has a scraping sleeve hole 1311 defined thereon. The scraping sleeve hole 1311 penetrates the scraping sleeve 13 in a wall thickness direction of the scraping sleeve 13. An inside of the scraping sleeve hole 1311 is opposite to an outside of the bristle 12. The bristle 12 is adapted to be extended out of or retracted into the scraping sleeve hole 1311 in the wall thickness direction of the scraping sleeve 13. It should be understood that the scraping sleeve 13 and the roller brush body 11 may rotate synchronously. During a rotation of the roller brush body 11, when any part of the roller brush body 11 is rotated to be opposite to the ground in an upward-downward direction, the bristle 12 on this part may be extended out of the scraping sleeve hole 1311 on the scraping sleeve 13 for ground cleaning. Since the roller brush body 11 is arranged eccentrically with respect to the scraping sleeve 13, the bristle 12 on this part may be retracted into the scraping sleeve hole 1311 as the rotation of the roller brush body 11 continues. In this case, hairs attached to or entangled around the bristle 12 can be scraped off by the scraping sleeve hole 1311 and sucked away by a vacuum cleaner 100. Thus, it is possible to avoid inconvenience of cleaning and a reduction in cleaning efficiency of the vacuum cleaner 100 due to thick hairs attached to the bristle 12. Therefore, user-friendliness of the use of the vacuum cleaner 100 can be enhanced.

With the scrubber brush assembly 1 according to an embodiment of the present disclosure, by arranging the roller brush body 11 eccentrically with respect to the scraping sleeve 13, the bristle 12 on the roller brush body 11 may be repeatedly extended out of and retracted into the scraping sleeve hole 1311 in a through hole direction of the scraping sleeve hole 1311 on the scraping sleeve 13 during a rotation of each of the roller brush body 11 and the scraping sleeve 13. During retracting the bristle 12 into the scraping sleeve hole 1311, hairs attached to the bristle 12 can be automatically cleaned by the scraping sleeve hole 1311 and sucked away by the vacuum cleaner 100. Therefore, the vacuum cleaner 100 can automatically cleaning the hairs during its operation, which eliminates a need of manual cleaning and enhances user-friendliness of a design of the vacuum cleaner 100. In addition, it is possible to prevent a reduction in cleaning efficiency due to hair blockage.

According to some embodiments of the present disclosure, in the radial direction of the roller brush body 11, a distance between a free end of the bristle 12 and the first rotation center line is equal to or greater than a maximum distance between the first rotation center line and an inner peripheral wall of the scraping sleeve 13. In this way, during the rotation of each of the roller brush body 11 and the scraping sleeve 13, the free end of the bristle 12 on the roller brush body 11 in a fully retracted state may be positioned in the scraping sleeve hole 1311 between the inner peripheral wall and an outer peripheral wall of the scraping sleeve 13, or may be slightly extended out of the scraping sleeve hole 1311 in the radial direction and beyond the outer peripheral wall of the scraping sleeve 13. Therefore, on the one hand, it is convenient for the scraping sleeve 13 to scrape off the hairs attached to the bristle 12 to a maximum extent. On the other hand, the bristle may normally be partially located in the scraping sleeve hole to prevent the free end of the bristle from being completely separated from the scraping sleeve hole when retracted, and further, to ensure that the bristle 12 can be extended and retracted smoothly in the through hole direction of the scraping sleeve hole 1311.

Figure 5:
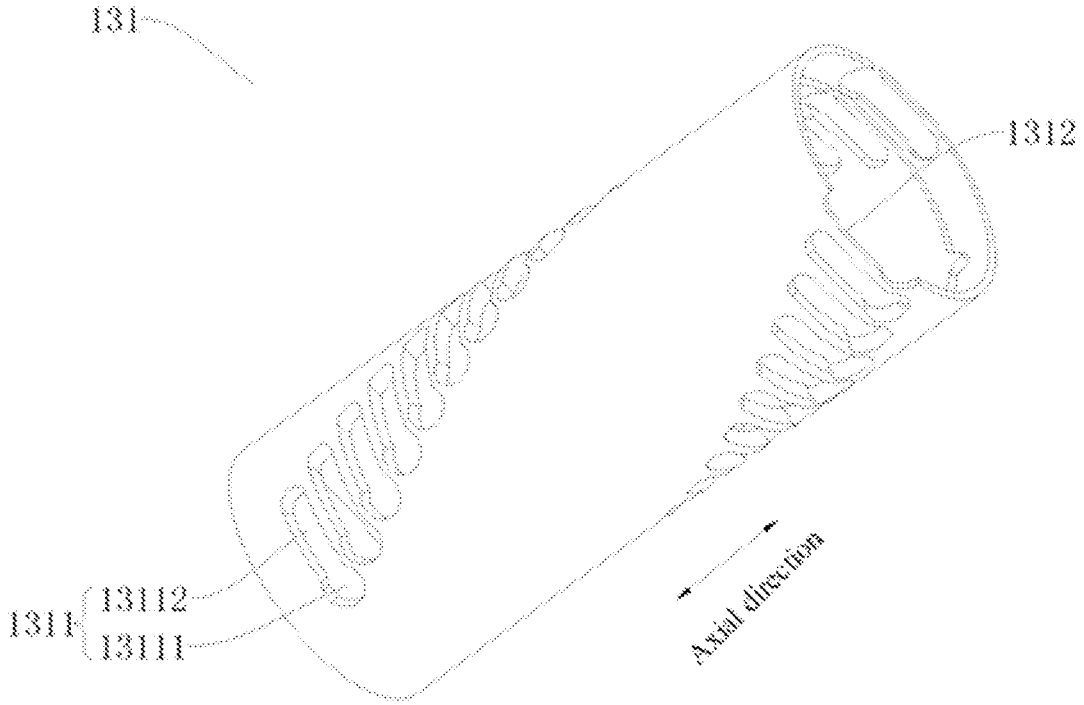
FIG. 5 is a schematic view of a scraping sleeve illustrated in FIG. 1.
Figure 6:
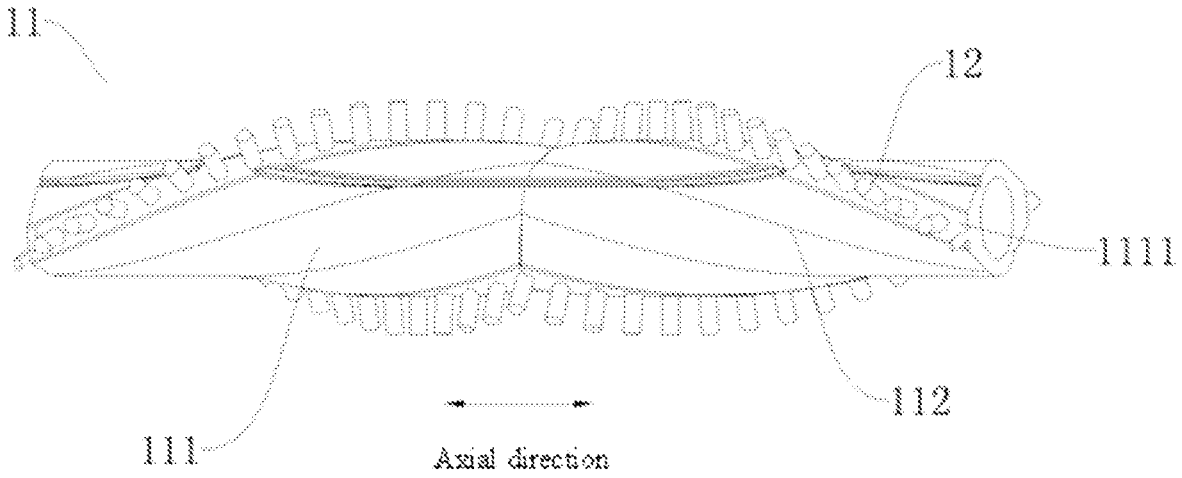
FIG. 6 is a schematic view of a roller brush body illustrated in FIG. 1.

According to some embodiments of the present disclosure, bristles 12 arranged at intervals in both a circumferential direction and an axial direction of the roller brush body 11 and scraping sleeve holes 1311 are provided. The scraping sleeve holes 1311 corresponds to the bristles 12 in a one-to-one correspondence. Therefore, the cleaning efficiency of the vacuum cleaner 100 can be improved. For example, as illustrated in FIG. 5 and FIG. 6, a first bristle group and a second bristle group may be spaced apart from each other in the circumferential direction of the roller brush body 11. Each of the first bristle group and the second bristle group includes bristles 12 spirally arranged on the roller brush body 11 in a direction of the first rotation center line. Accordingly, a first scraping sleeve hole group and a second scraping sleeve hole group may be spaced apart from each other in a circumferential direction of the scraping sleeve 13. Each of the first scraping sleeve hole group and the second scraping sleeve hole group includes scraping sleeve holes 1311 spirally arranged on the scraping sleeve 13 in a direction of the second rotation center line. The scraping sleeve holes 1311 corresponds to the bristles 12 in a one-to-one correspondence.

In some embodiments of the present disclosure, the bristle 12 may have a diameter smaller than a minimum width of the scraping sleeve hole 1311. In this manner, the bristle 12 can be easily extended out of or retracted into the scraping sleeve hole 1311 to prevent the bristle 12 from being stuck in the scraping sleeve hole 1311.

Since an eccentric distance is formed between a rotation center axis of the scraping sleeve 13 and a rotation center axis of the roller brush body 11, when the scraping sleeve 13 and the roller brush body 11 are rotated synchronously, the roller brush body 11 can rotate relative to the scraping sleeve 13 at a radius of the eccentric distance between the rotation center axis of the scraping sleeve 13 and the rotation center axis of the roller brush body 11, and thus the bristle 12 arranged on the roller brush body 11, along with roller brush body 11, also rotate relative to the scraping sleeve 13 at the radius of the eccentric distance between the rotation center axis of the scraping sleeve 13 and the rotation center axis of the roller brush body 11. In order to ensure that the bristle 12 has sufficient movement space in the circumferential direction of the scraping sleeve 13, according to some embodiments of the present disclosure, a length of the scraping sleeve hole 1311 in the circumferential direction of the scraping sleeve 13 is equal to or greater than 2 times an eccentric distance between the first rotation center line and the second rotation center line. In this manner, it is ensured that the bristle 12 can have sufficient stroke in the scraping sleeve hole 1311 to prevent the scraping sleeve 13 from interfering with the relative rotational movement of the roller brush body 11.

In some embodiments of the present disclosure, the scraping sleeve hole 1311 is formed as an elongated slot extending in the circumferential direction of the scraping sleeve 13. In this manner, it is convenient for the bristle 12 to be extended and retracted relative to the scraping sleeve hole 1311 in the radial direction of the roller brush body 11 while performing a circular movement in the scraping sleeve hole 1311, to prevent the bristle 12 from interfering with a circumferential wall of the scraping sleeve hole 1311.

According to some embodiments of the present disclosure, each of the scraping sleeve holes 1311 includes a first hole portion 13111 in a circular shape and a second hole portion 13112 connected to the first hole portion 13111 in the circumferential direction of the scraping sleeve 13. The second hole portion 13112 extends away from the first hole portion 13111 in the circumferential direction of the scraping sleeve 13. Here, a width of the second hole portion 13112 in an axial direction of the scraping sleeve 13 is smaller than a diameter of the first hole portion 13111. In this manner, the first hole portion 13111 and the second hole portion 13112 may cooperate with each other to define a movement channel for the bristle 12 and to allow the bristle 12 to move smoothly. In addition, the smaller width of the second hole portion 13112 further facilitates scraping the hairs off the bristle by a side wall of the scraping sleeve hole 1311.

In some embodiments of the present disclosure, a circumferential wall of the second hole portion 13112 at an end thereof facing away from the first hole portion 13111 is a columnar circular arc surface. In this manner, the second hole portion 13112 may match with the bristle 12 in shape, to prevent the bristle 12 from getting stuck.

According to some embodiments of the present disclosure, an outer peripheral wall of the roller brush body 11 has protruding ribs 1111 (such as a first protruding rib and a second protruding rib described below) formed thereon and extending spirally in the axial direction of the roller brush body 11. Each of the protruding ribs 1111 has bristles 12 provided on an outer end surface thereof. The bristles 12 is arranged at intervals in an extending direction of the protruding rib 1111. By providing the protruding ribs 1111 and arranging the bristles 12 on the protruding ribs 1111, a length of each of the bristles 12 can be shortened to ensure stiffness of the bristle 12 and the cleaning efficiency.

For example, as illustrated in FIG. 6, two protruding ribs 1111 may be formed on the outer peripheral wall of the roller brush body 11. The two protruding ribs 1111 include the first protruding rib and the second protruding rib, and each extend spirally in the axial direction of the roller brush body 11. The first bristle group is disposed on the first protruding rib. The second bristle group is disposed on the second protruding rib. The bristles 12 of the first bristle group is arranged at intervals in an extending direction of the first protruding rib. The bristles 12 of the second bristle group is arranged at intervals in an extending direction of the second protruding rib. Therefore, it is ensured that the bristle 12 on the roller brush body 11 can normally act against the ground for cleaning during an operation of the vacuum cleaner 100, and a structure of the roller brush body 11 can also be simplified.

Of course, the present disclosure is not limited thereto. The roller brush body 11 may also have three protruding ribs 1111 and three bristle groups. The three bristle groups correspond to the three protruding ribs 1111 in a one-to-one correspondence. Accordingly, the scraping sleeve 13 may also have three scraping sleeve hole groups defined thereon. The three scraping sleeve hole groups correspond to the three bristle groups in a one-to-one correspondence.

Figure 9:
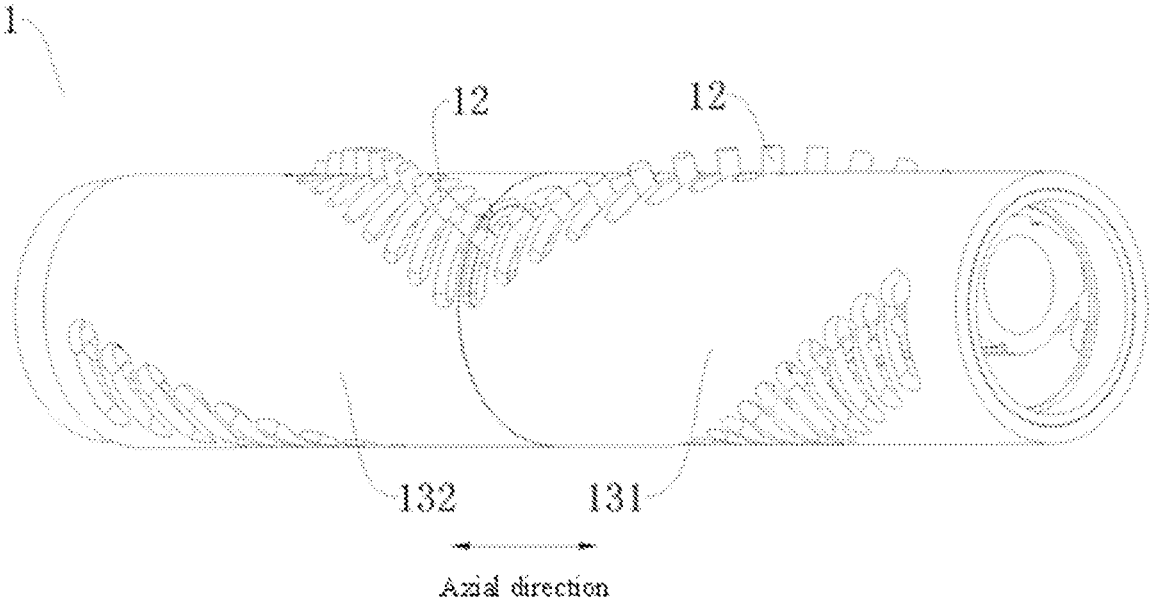
FIG. 9 is a schematic view of the scrubber brush assembly illustrated in FIG. 8 from another view.
Figure 10:
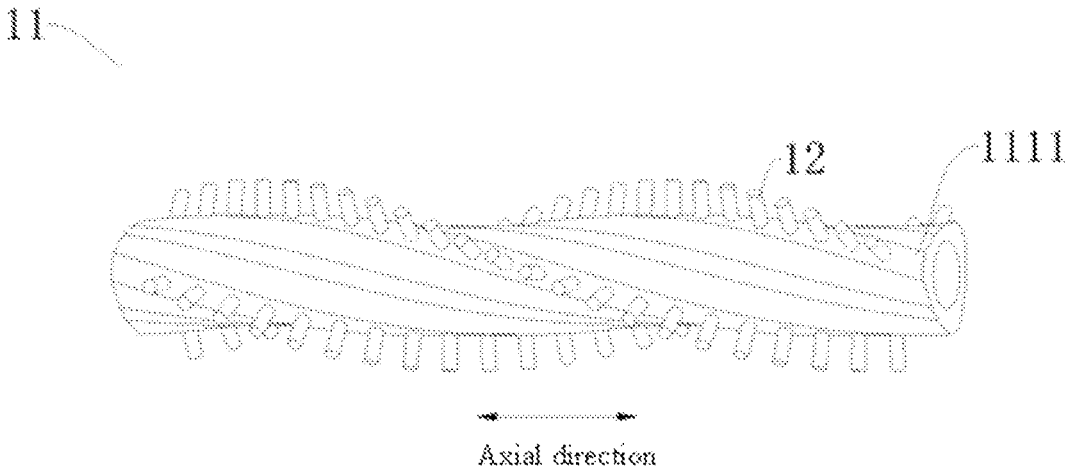
FIG. 10 is a schematic view of the roller brush body illustrated in FIG. 6 according to another embodiment.

Further, as illustrated in FIG. 9 and FIG. 10, the roller brush body 11 may include a first roller brush body segment 111 and a second roller brush body segment 112. In an embodiment, the first roller brush body segment 111 and the second roller brush body segment 112 are sequentially arranged axially. A helical direction of the protruding rib 1111 on the first roller brush body segment 111 is opposite to a helical direction of the protruding rib 1111 on the second roller brush body segment 112. The protruding rib 1111 on the first roller brush body segment 111 is connect to the protruding rib 1111 on the second roller brush body segment 112. In this manner, two segments of the roller brush body 11 in the axial direction can clean the ground simultaneously during the operation of the vacuum cleaner 100, to prevent the ground passed by the vacuum cleaner 100 from being partially missed for cleaning. Of course, the present disclosure is not limited in this regard. The roller brush body 11 may also be formed as a one-piece member.

Further, the scraping sleeve 13 may include a first scraping sleeve segment 131 and a second scraping sleeve segment 132. In an embodiment, the first scraping sleeve segment 131 is sleeved over the first roller brush body segment 111, and the second scraping sleeve segment 132 is sleeved over the second roller brush body segment 112. The first scraping sleeve segment 131 is detachably connected to the second scraping sleeve segment 132. In this manner, the first roller brush segment 111 can be cleaned by the first scraping sleeve segment 131, and the second roller brush segment 112 can be cleaned by the second scraping sleeve segment 132. Of course, the present disclosure is not limited in this regard. The scraping sleeve 13 may be formed as a one-piece member.

Further, the first scraping sleeve segment 131 has a first circumferential positioning portion 1312 formed thereon. The second scraping sleeve segment 132 has a second circumferential positioning portion 1321 formed thereon. The first circumferential positioning portion 1312 is in a positioning-fit with the second circumferential positioning portion 1321 to limit movements of the first scraping sleeve segment 131 and the second scraping sleeve segment 132 in the circumferential direction. Therefore, the first scraping sleeve segment 131 and the second scraping sleeve segment 132 can rotate synchronously.

In some embodiments, the first circumferential positioning portion 1312 may be formed as a positioning groove, and is recessed in an axial direction of the first scraping sleeve segment 131. The second circumferential positioning portion 1321 is formed as a positioning protrusion protruding in an axial direction of the second scraping sleeve segment 132. The second circumferential positioning portion 1321 protrudes in the axial direction of the second scraping sleeve segment 132. The first circumferential positioning portion 1312 is engaged with the second circumferential positioning portion 1321 to limit a relative movement of the first scraping sleeve segment 131 and the second scraping sleeve segment 132 in the circumferential direction.

As illustrated in FIG. 1, the scrubber brush assembly 1 according to an embodiment of the present disclosure includes a housing 14, the roller brush body 11, and the scraping sleeve 13.

In an embodiment, the housing 14 has an accommodation space defined therein. An inner surface of the housing 14 at a position corresponding to the accommodation space is at least partially formed as a cylindrical surface extending in the horizontal direction. In an embodiment, as illustrated in FIG. 1, a front upper part of the housing 14 of the scrubber brush assembly 1 is formed in a shape of a circular arc plate having an axis extending in the horizontal direction. In an embodiment, the circular arc plate may be substantially formed as a quarter of a cylindrical panel and has a center line extending in the horizontal direction.

The roller brush body 11 has the first rotation center line extending in the horizontal direction, and is rotatable around the first rotation center line. In addition, the first rotation center line is eccentrically arranged with respect to a center line of a circumferential wall of the cylindrical surface of the accommodation space. The bristle 12 extending in the radial direction of the roller brush body 11 is disposed on the roller brush body 11.

The scraping sleeve 13 may be disposed in the housing 14. The scraping sleeve 13 is sleeved over the roller brush body 11 and has the second rotation center line extending in the horizontal direction. The scraping sleeve 13 is rotatable around the second rotation center line, and the second rotation center line is coincident with the center line of the circumferential wall of the cylindrical surface of the accommodation space of the housing 14. Here, the scraping sleeve hole 1311 is defined on the scraping sleeve 13 and penetrates the scraping sleeve 13 in the wall thickness direction of the scraping sleeve 13. Positions of scraping sleeve holes 1311 correspond to positions of bristles 12 in a one-to-one correspondence. The bristle 12 is adapted to be extended out of and retracted into the scraping sleeve hole 1311 in the wall thickness direction of the scraping sleeve 13 when the roller brush body 11 and the scraping sleeve 13 rotate.

Here, the first rotation center line of the roller brush body 11 is eccentrically arranged with respect to the center line of the circumferential wall of the cylindrical surface of the accommodation space, and the second rotation center line of the scraping sleeve 13 is coincident with the center line of the circumferential wall of the cylindrical surface of the accommodation space. Therefore, the first rotation center line of the roller brush body 11 is non-coincident with the second rotation center line of the scraping sleeve. That is, the roller brush body 11 is eccentrically arranged with respect to the scraping sleeve 13. When the vacuum cleaner 100 is in operation, the scraping sleeve 13 and the roller brush body 11 may be rotated synchronously. In this manner, when the vacuum cleaner 100 is in operation, during the rotation of the roller brush body 11, when any part of the roller brush body 11 is rotated to be opposite to the ground in an upward-downward direction, the bristle 12 on this part may be extended out of the scraping sleeve hole 1311 on the scraping sleeve 13 for ground cleaning. Since the roller brush body 11 is eccentrically arranged with respect to the scraping sleeve 13, the bristle 12 on this part may be retracted into the scraping sleeve hole 1311 as the rotation of the roller brush body 11 continues. In this case, the hairs attached to or entangled on the bristle 12 can be scraped off by the scraping sleeve hole 1311 and sucked away by the vacuum cleaner 100 to avoid inconvenience of cleaning and a reduction in the cleaning efficiency of the vacuum cleaner 100 due to thick hairs attached to the bristle 12. Therefore, user-friendliness of the use of the vacuum cleaner 100 can be enhanced.

With the scrubber brush assembly 1 according to an embodiment of the present disclosure, by concentrically arranging the scraping sleeve 13 with the cylindrical surface of the housing 14 and eccentrically arranging the roller brush body 11 with the cylindrical surface of the housing 14, the roller brush body 11 is eccentrically arranged with respect to the scraping sleeve 13. In this manner, the bristle 12 on the roller brush body 11 may be repeatedly extended out of and retracted into the scraping sleeve hole 1311 in the through hole direction of the scraping sleeve hole 1311 on the scraping sleeve 13 during the rotation of the roller brush body 11 and the scraping sleeve 13. During retracting the bristle 12 into the scraping sleeve hole 1311, the hairs attached to the bristle 12 can be automatically cleaned by the scraping sleeve hole 1311 and sucked away by the vacuum cleaner 100. Therefore, the vacuum cleaner 100 can automatically clean the hairs during an operation, which eliminates a need for manual cleaning and enhances user-friendliness of the design of the vacuum cleaner 100, to prevent a reduction in the cleaning efficiency due to hair blockage.

According to some embodiments of the present disclosure, the scrubber brush assembly 1 according to embodiments of the present disclosure includes the housing 14, the roller brush body 11, and the scraping sleeve 13. In an embodiment, the housing 14 has the accommodation space defined therein. The inner surface of the housing 14 at the position corresponding to the accommodation space is at least partially formed as the cylindrical surface extending in the horizontal direction. In an embodiment, as illustrated in FIG. 1, the front upper part of the housing 14 of the scrubber brush assembly 1 is formed in the shape of the circular arc plate having the axis extending in the horizontal direction. In an embodiment, the circular arc plate may be substantially formed as a quarter of the cylindrical panel and has the center line extending in the horizontal direction.

The roller brush body 11 has the first rotation center line extending in the horizontal direction and is rotatable around the first rotation center line. In addition, the first rotation center line is coincident with the center line of the circumferential wall of the cylindrical surface of the accommodation space. The bristle 12 extending in the radial direction of the roller brush body 11 is arranged on the roller brush body 11.

The scraping sleeve 13 may be disposed in the housing 14. The scraping sleeve 13 is sleeved over the roller brush body 11 and has the second rotation center line extending in the horizontal direction. The scraping sleeve 13 is rotatable around the second rotation center line. The scraping sleeve 13 may be disposed in the housing 14. The second rotation center line of the scraping sleeve 13 may be eccentrically arranged with respect to the center line of the circumferential wall of the cylindrical surface of the housing 14. Here, the scraping sleeve 13 is sleeved over the roller brush body 11. The scraping sleeve hole 1311 is defined on the scraping sleeve 13 and penetrates the scraping sleeve 13 in the wall thickness direction of the scraping sleeve 13. Positions of scraping sleeve holes 1311 correspond to positions of bristles 12 in a one-to-one correspondence. The bristle 12 is adapted to be extended out of and retracted into the scraping sleeve hole 1311 in the wall thickness direction of the scraping sleeve 13 when the roller brush body 11 and the scraping sleeve 13 rotate.

Here, the first rotation center line of the roller brush body 11 is eccentrically arranged with respect to the center line of the circumferential wall of the cylindrical surface of the accommodation space, and the second rotation center line of the scraping sleeve 13 is coincident with the center line of the circumferential wall of the cylindrical surface of the accommodation space. Therefore, the first rotation center line of the roller brush body 11 is non-coincident with the second rotation center line of the scraping sleeve. That is, the roller brush body 11 is eccentrically arranged with respect to the scraping sleeve 13. It should be noted that, when the vacuum cleaner 100 is in operation, the scraping sleeve 13 and the roller brush body 11 may rotates synchronously. In this manner, when the vacuum cleaner 100 is in operation, during the rotation of the roller brush body 11, when any part of the roller brush body 11 is rotated to be opposite to the ground in the upward-downward direction, the bristle 12 on this part may be extended out of the scraping sleeve hole 1311 on the scraping sleeve 13 for ground cleaning. Since the roller brush body 11 is eccentrically arranged with respect to the scraping sleeve 13, the bristle 12 on this part may be retracted into the scraping sleeve hole 1311 as the rotation of the roller brush body 11 continues. In this case, the hairs attached to or entangled on the bristle can be scraped off by the scraping sleeve hole 1311 and sucked away by the vacuum cleaner 100 to avoid inconvenience of cleaning and a reduction in the cleaning efficiency of the vacuum cleaner 100 due to thick hairs attached to the bristle 12. Therefore, user-friendliness of the use of the vacuum cleaner 100 can be enhanced.

With the scrubber brush assembly 1 according to an embodiment of the present disclosure, by concentrically arranging the roller brush body 11 with the cylindrical surface of the housing 14 and eccentrically arranging the scraping sleeve 13 with respect to the cylindrical surface of the housing 14, the roller brush body 11 is eccentrically arranged with respect to the scraping sleeve 13. In this manner, the bristle 12 on the roller brush body 11 may be repeatedly extended out of and retracted into the scraping sleeve hole 1311 in the wall thickness direction of the scraping sleeve hole 1311 on the scraping sleeve 13 during the rotation of the roller brush body 11 and the scraping sleeve 13. During retracting the bristle 12 into the scraping sleeve hole 1311, the hairs attached to the bristle 12 can be automatically cleaned by the scraping sleeve hole 1311 and sucked away by the vacuum cleaner 100. Therefore, the vacuum cleaner 100 can automatically clean the hairs during an operation, which eliminates a need for manual cleaning and enhances user-friendliness of the design of the vacuum cleaner 100, to prevent a reduction in the cleaning efficiency due to hair blockage.

Figure 4:
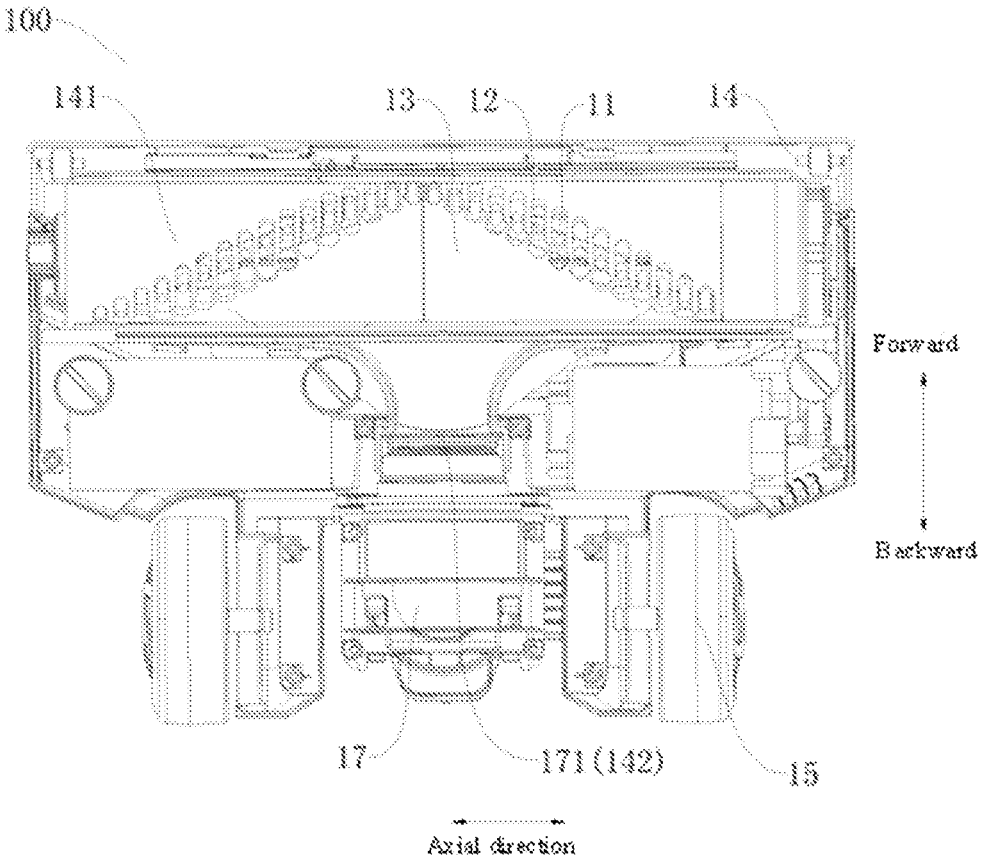
FIG. 4 is a bottom view of the vacuum cleaner illustrated in FIG. 1.

According to some embodiments of the present disclosure, the housing 14 has a dust suction inlet 141 and a dust suction outlet 142 that are defined thereon and in communication with the accommodation space. In an embodiment, as illustrated in FIG. 4, the dust suction inlet 141 may be defined at a bottom of the housing 14, and the dust suction outlet 142 may be defined at a rear part of the housing 14. In a circumferential direction of the roller brush body 11, the bristle 12 at a position corresponding to the dust suction inlet 141 is capable of being extended out of the scraping sleeve hole 1311 by a longest length. That is, when any part of the roller brush body 11 is rotated opposite to the dust suction inlet 141, the bristle 12 on this part can be extended out of the scraping sleeve hole 1311 by the longest length. Therefore, it is convenient for the bristle 12 to be extended out of the dust suction inlet 141 for ground cleaning.

It should be understood that when the bristle 12 on this part continues rotating and is rotated from the dust suction inlet 141 towards the dust suction outlet 142, the bristle 12 is gradually retracted into the scraping sleeve hole 1311. In addition, when the bristle 12 on this part directly faces the dust suction outlet 142, the bristle 12 is capable of being extending out of the scraping sleeve hole 1311 by a shortest length. Since an air amount at the dust suction outlet 142 is the greatest, such a manner is beneficial for the vacuum cleaner 100 to suck away dust and hairs scraped off by the scraping sleeve hole 1311 from the bristle 12, which in turn can fully improve the cleaning efficiency of the vacuum cleaner 100.

As illustrated in FIG. 22 to FIG. 26, the scrubber brush assembly 1 according to an embodiment of the present disclosure also includes a first driving device 16 connected to the roller brush body 11 and the scraping sleeve 13, respectively. The first driving device is configured to drive the roller brush body 11 and the scraping sleeve 13 to rotate. The bristle is adapted to be extended out of and retracted into the scraping sleeve hole in a radial direction of the scraping sleeve during the rotation of the roller brush body and the scraping sleeve. With the scrubber brush assembly 1 according to an embodiment of the present disclosure, the roller brush body 11 is eccentrically arranged with respect to the scraping sleeve 13. During driving the roller brush body 11 and the scraping sleeve 13 by the first driving device 16 to rotate, the bristle 12 on the roller brush body 11 may be extended out of and retracted into the scraping sleeve hole 1311 in the through hole direction of the scraping sleeve hole 1311 on the scraping sleeve 13. During retracting the bristle 12 into the scraping sleeve hole 1311, the hairs attached to the bristle 12 can be automatically cleaned by the scraping sleeve hole 1311 and sucked away by the vacuum cleaner 100. Therefore, the vacuum cleaner 100 can automatically clean the hairs during its operation, which eliminates a need for manual cleaning and enhances user-friendliness of the design of the vacuum cleaner 100, to prevent a reduction in the cleaning efficiency due to hair blockage.

Figure 24:
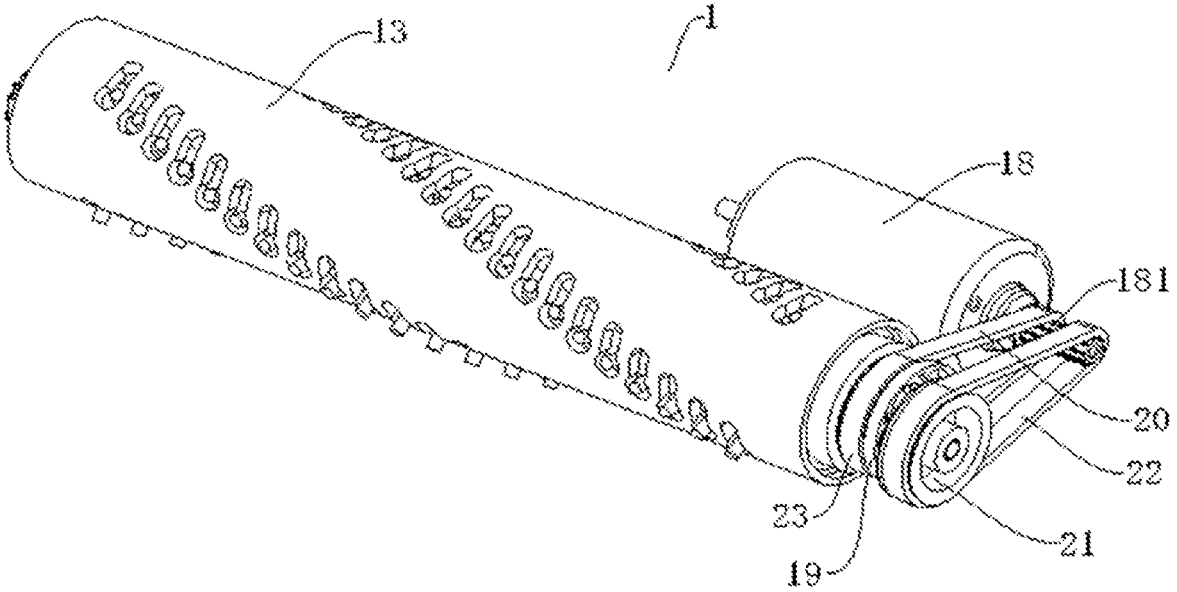
FIG. 24 is a perspective view of a scrubber brush assembly according to an embodiment of the present disclosure.

According to some embodiments of the present disclosure, as illustrated in FIG. 24, the first driving device 16 includes a first driving motor 18 having a driving shaft, a first driving gear 181 coaxially fixed with the driving shaft, a first transmission assembly connected between the first driving gear 181 and the scraping sleeve 13 in a transmission manner, and a second transmission assembly connected between the first driving gear and the roller brush body 11 in a transmission manner. In this manner, the first driving gear 181 is driven by the first driving motor 18 to rotate. The scraping sleeve 13 is driven by the first driving gear 181 via the first transmission assembly to rotate. The roller brush body 11 is driven by the first driving gear 181 via the second transmission assembly to rotate. Therefore, the roller brush body 11 and the scraping sleeve 13 can be driven to rotate simultaneously. Also, such a structure is stable.

In an embodiment, the connection in the transmission manner may be achieved, by gears, between the first driving gear 181 and the scraping sleeve 13 and between the first driving gear 181 and the roller brush body 11, or the connection in the transmission manner may be achieved, through an engagement between a conveyor belt and gears, between the first driving gear 181 and the scraping sleeve 13 and between the first driving gear 181 and the roller brush body 11.

Figure 23:
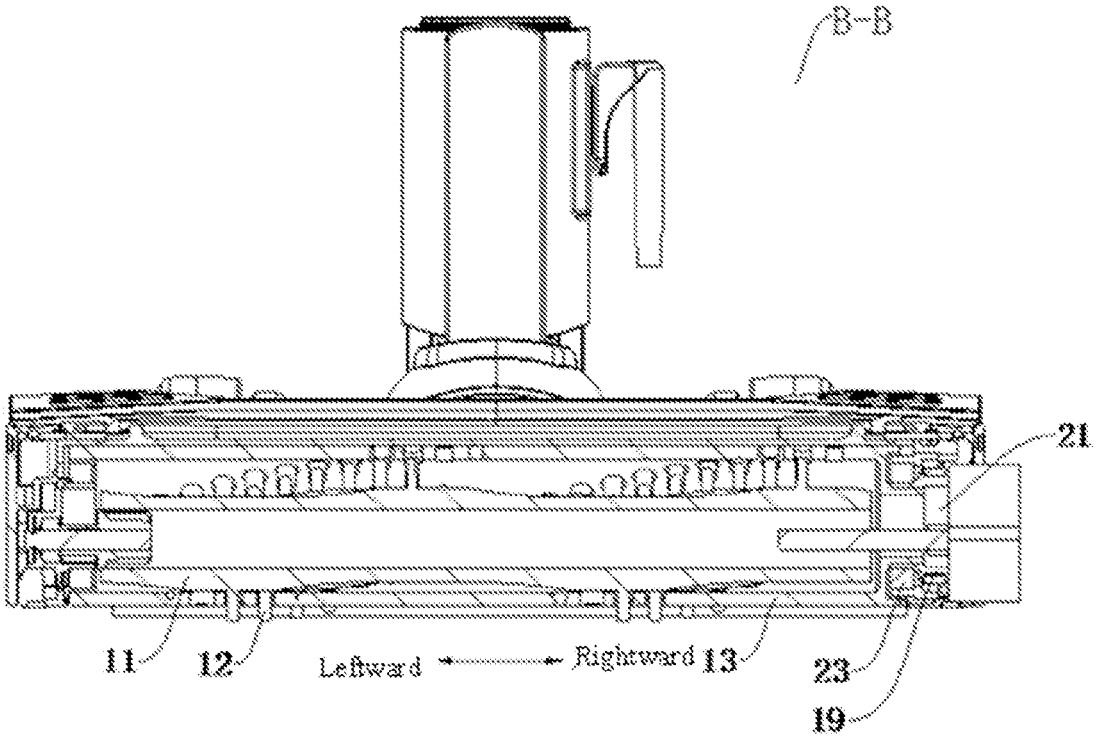
FIG. 23 is a cross-sectional view taken along line B-B in FIG. 22.

In some embodiments of the present disclosure, as illustrated in FIG. 23 and FIG. 24, the first transmission assembly includes a first transmission gear 19 and a first driving belt 20.

The first transmission gear 19 is connected to the scraping sleeve 13. Here, the first transmission gear 19 and the scraping sleeve 13 may be two separate members. The first transmission gear 19 is connected to the scraping sleeve 13 through a threaded connection, an adhesive connection, etc. Or, the first transmission gear 19 and the scraping sleeve 13 are formed into one piece. In an embodiment, teeth are machined on an outer peripheral wall of the scraping sleeve 13 to simplify an assembly process.

The first driving belt 20 is tensioned between the first driving gear 181 and the first transmission gear 19 to ensure a proper tensioning force is exerted on a belt during a transmission to avoid a belt slippage, or avoid belt derailment due to a tooth escape or tooth detachment.

In this manner, the first driving belt 20 is driven by the first driving gear 181 to move, and the first transmission gear 19 is driven by the first driving belt 20 to rotate to drive the scraping sleeve 13 to rotate. Such a structure is simple and reliable.

Figure 25:
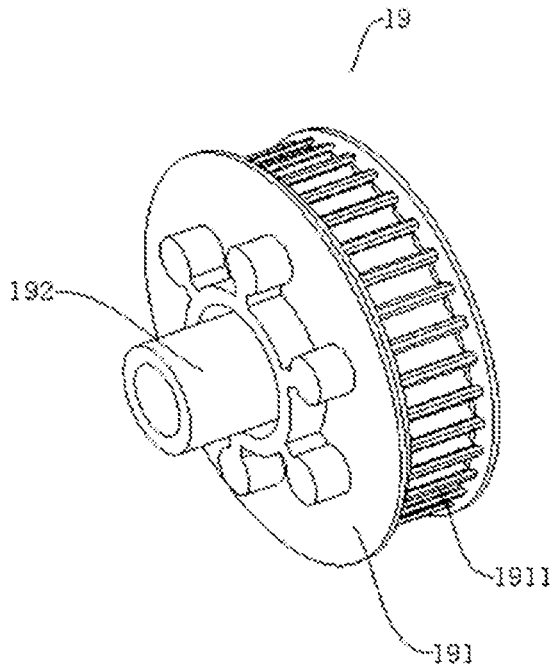
FIG. 25 is a perspective view of a first transmission gear according to an embodiment of the present disclosure.

In some embodiments of the present disclosure, as illustrated in FIG. 25, the first transmission gear 19 includes a first transmission ring 191 and a first connection ring 192.

The first transmission ring 191 has a first transmission tooth portion 1911 formed on an outer surface thereof and in a transmission engagement with the first driving belt 20. The first connection ring 192 has one end connected to a side of the first transmission ring 191 facing towards the scraping sleeve 13, and another end connected to the scraping sleeve 13. In this manner, the first driving belt 20 drives, by driving the first transmission ring 191 to rotation, the first connection ring 192 to rotate synchronously, to drive the scraping sleeve 13 to rotate synchronously. In an embodiment, a right end of the first connection ring 192 is connected to a left side of the first transmission ring 191, and a left end of the first connection ring 192 is sleeved over the outer peripheral wall of the scraping sleeve 13. Here, the first transmission ring 191 and the first connection ring 192 may be formed into one piece to realize a high degree of integration and a compact structure and eliminate corresponding assembly steps. The first transmission ring 191 and the first connection ring 192 may also be two separate members.

In an embodiment, as illustrated in FIG. 23 and FIG. 24, the first transmission assembly also includes a compression ring 23 sleeved over the first connection ring 192 and configured to tightly press the first connection ring 192 against the outer peripheral wall of the scraping sleeve 13. In this manner, the first connection ring 192 is tightly sandwiched between the compression ring 23 and the scraping sleeve 13 to provide a stable connection between the first connection ring 192 and the scraping sleeve 13.

In some embodiments of the present disclosure, as illustrated in FIG. 23 and FIG. 24, the second transmission assembly includes a second transmission gear 21 and a second driving belt 22.

The second transmission gear 21 is connected to the roller brush body 11. Here, the second transmission gear 21 and the roller brush body 11 may be two separate members. The second transmission gear 21 is connected to the roller brush body 11 by a threaded connection, an adhesive connection, etc. Or, the second transmission gear 21 and the roller brush body 11 are formed into one piece. In an embodiment, teeth are machined on the outer peripheral wall of the roller brush body 11 to simplify an assembly process.

The second driving belt 20 is tensioned between the first driving gear 181 and the second transmission gear 21 to ensure a proper tensioning force is exerted on a belt during a transmission to avoid a belt slippage, or avoid belt derailment due to a tooth escape or tooth detachment.

In this manner, the second driving belt 22 is driven by the first driving gear 181 to move, and the second transmission gear 21 is driven by the second driving belt 22 to rotate to drive the roller brush body 11 to rotate. Such a structure is simple and reliable.

Figure 26:
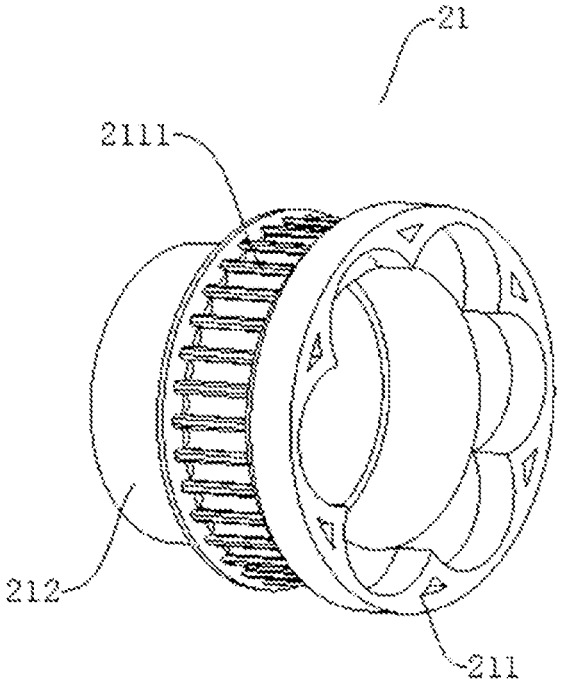
FIG. 26 is a perspective view of a second transmission gear according to an embodiment of the present disclosure.

In some embodiments of the present disclosure, as illustrated in FIG. 26, the second transmission gear 21 includes an engagement ring plate 211, a connection sleeve 212, and a radial plate.

The engagement ring plate 211 is in a cylindric shape extending axially and has a second transmission tooth portion 2111 formed on an outer surface thereof. The second transmission tooth portion 2111 is in a transmission engagement with the second driving belt 22. The connection sleeve 212 is in a cylindric shape extending in an axial direction of the roller brush body 11 and located on an inner side of the engagement ring plate 211. An end of the connection sleeve 212 facing towards the roller brush body 11 is connected to the roller brush body 11. The radial plate extends in the radial direction of the roller brush body 11, and is connected to each of the engagement ring plate 211 and the connection sleeve 212. In this manner, the engagement ring plate 211 is driven by the second driving belt 22 to rotate. The connection sleeve 212 is driven by the engagement ring plate 211 to rotate synchronously. The roller brush body 11 is driven by the connection sleeve 212 to rotate synchronously.

In an embodiment, the engagement ring plate 211 and the connection sleeve 212 extend in a left direction and a right direction, respectively. The radial plate is in a circular shape. A left end of the connection sleeve 212 is connected to the roller brush body 11. A right end of the connection sleeve 212 is connected to an inner peripheral wall of the radial plate. A left end of the engagement ring plate 211 is connected to an outer peripheral wall of the radial plate. Here, the engagement ring plate 211, the connection sleeve 212, and the radial plate may be formed into one piece to realize a high degree of integration and a compact structure and eliminate corresponding assembly steps.

In an embodiment, as illustrated in FIG. 23, the second transmission assembly also includes a transmission shaft. The connection sleeve 212 is sleeved over the transmission shaft. An end of the transmission shaft facing towards the roller brush body 11 is connected to the roller brush body 11. In this manner, the transmission shaft is driven by the connection sleeve 212 to rotate synchronously to drive the roller brush body 11 to rotate synchronously, which facilitates a connection and assembly between the connection sleeve 212 and the roller brush body 11.

In some embodiments of the present disclosure, the first transmission gear 19 and the second transmission gear 21 have a same number of teeth.

As illustrated in FIG. 23 and FIG. 24, the first driving gear 181 is driven by the first driving motor 18 to rotate. Each of the first driving belt 20 and the second driving belt 22 is driven by the first driving gear 182 to move at a same linear speed. Since the first transmission gear 19 and the second transmission gear 21 have the same number of teeth, i.e., a ratio of a number of teeth of the first transmission gear 19 to a number of teeth of the first driving gear 181 is identical to a ratio of a number of teeth of the second transmission gear 21 to a number of teeth of the first driving gear 181, it is ensured that the first transmission gear 19 and the second transmission gear 21 may rotate synchronously at a same angular speed. In addition, the scraping sleeve 13 is driven by the first transmission gear 19 to rotate synchronously at a same angular speed, and the roller brush body 11 is driven by the second transmission gear 21 to rotate synchronously at the same angular speed.

Such a manner can ensure the scraping sleeve 13 and the roller brush body 11 to rotate synchronously at the same angular speed, to ensure a position of the bristle 12 corresponds to a position of the scraping sleeve hole 1311 in the circumferential direction. Further, it is ensured that the bristle 12 can be extended out of and retracted into the respective scraping sleeve hole 1311 in a radial direction of the scraping sleeve 13.

In some embodiments of the present disclosure, two pairs of belts and pulleys having engagement details may be employed to replace the first transmission gear 19 and the first driving belt 20 as well as the second transmission gear 21 and the second driving belt 22. In this manner, a use risk can be reduced, and service life can be prolonged, to ensure transmission efficiency. In addition, the engagement details can avoid assembly errors or jamming caused by a tooth escape of the belt.

As illustrated in FIG. 13 to FIG. 21, the scrubber brush assembly 1 according to an embodiment of the present disclosure also includes a second driving device connected to one of the roller brush body 11 and the scraping sleeve 13. The one of the roller brush body 11 and the scraping sleeve 13 is in a transmission connection with the other of the roller brush body 11 and the scraping sleeve 13. In an embodiment, the second driving device is connected to the roller brush body 11, and the roller brush body 11 is in a transmission connection with the scraping sleeve 13; or the second driving device is connected to the scraping sleeve 13, and the scraping sleeve 13 is in a transmission connection with the roller brush body 11. In addition, the bristle is adapted to be extended out of and retracted into the scraping sleeve hole in the radial direction of the scraping sleeve during a rotation of the roller brush body and the scraping sleeve.

With the scrubber brush assembly 1 according to an embodiment of the present disclosure, the roller brush body 11 is eccentrically arranged with respect to the scraping sleeve 13. The roller brush body 11 and the scraping sleeve 13 are driven by the second driving device to rotate. The bristle 12 on the roller brush body 11 may be extended out of and retracted into the scraping sleeve hole 1311 in the through hole direction of the scraping sleeve hole 1311 on the scraping sleeve 13. During retracting the bristle 12 into the scraping sleeve hole 1311, the hairs attached to the bristle 12 can be automatically cleaned by the scraping sleeve hole 1311 and sucked away by the vacuum cleaner 100. Therefore, the vacuum cleaner 100 can automatically clean the hairs during its operation, which eliminates a need for manual cleaning and enhances user-friendliness of the design of the vacuum cleaner 100, to prevent a reduction in the cleaning efficiency due to hair blockage.

Figure 14:
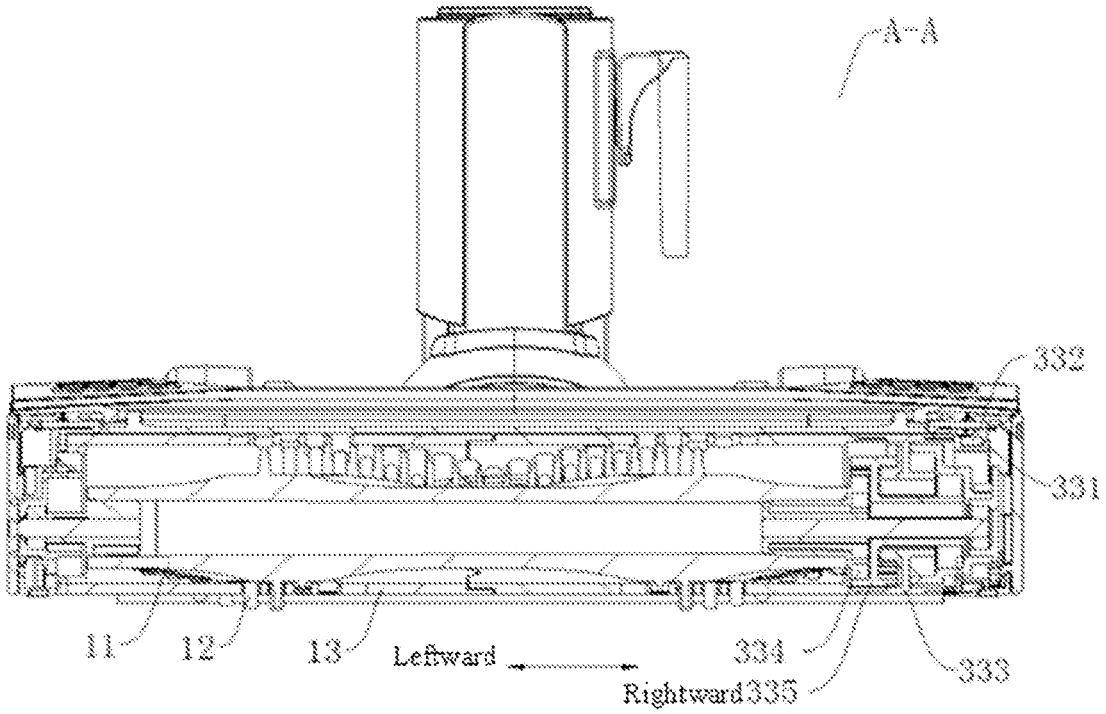
FIG. 14 is a cross-sectional view taken along line A-A in FIG. 13.
Figure 15:
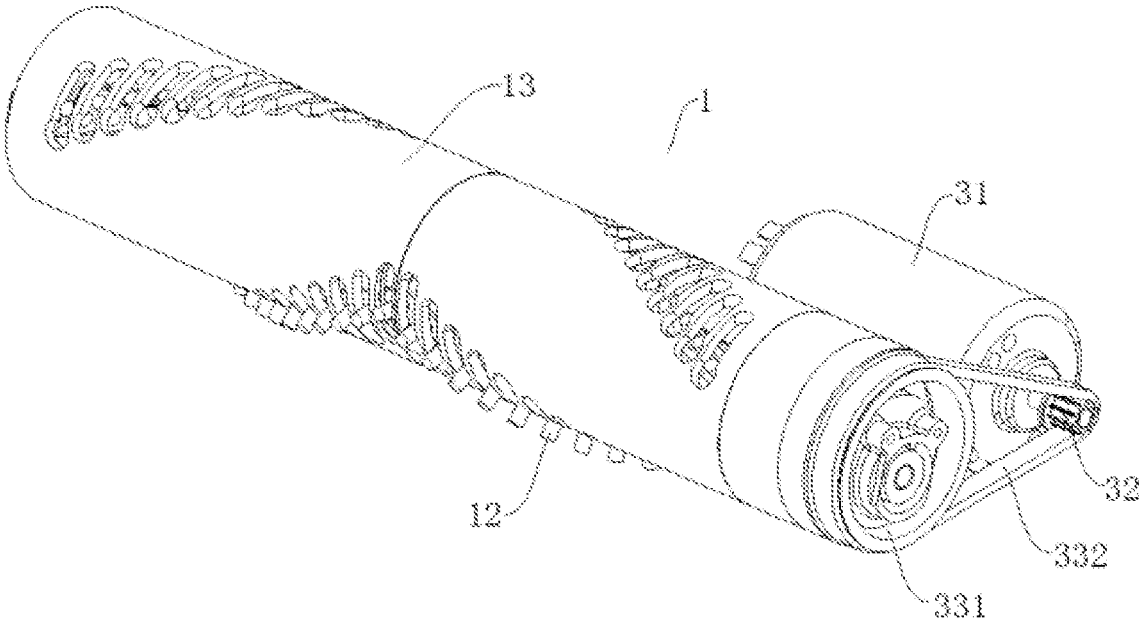
FIG. 15 is a perspective view of a scrubber brush assembly according to an embodiment of the present disclosure.
Figure 16:
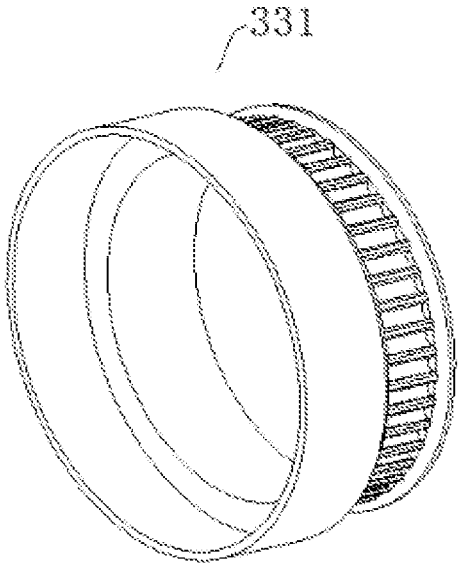
FIG. 16 is a perspective view of a third transmission gear according to an embodiment of the present disclosure.

According to some embodiments of the present disclosure, as illustrated in FIG. 14 and FIG. 15, the second driving device includes a second driving motor 31 having a second driving shaft, and a transmission assembly connected between the second driving shaft and the scraping sleeve 13. In this manner, the scraping sleeve 13 is driven by the second driving motor 31 through a transmission of the transmission assembly to rotate.

In some embodiments of the present disclosure, as illustrated in FIG. 14, the second driving device also includes a second driving gear 32 coaxially fixed with the second driving shaft. The transmission assembly includes a third transmission gear 331 connected to the scraping sleeve 13, and a third driving belt 332 tensioned between the second driving gear 32 and the third transmission gear 331 to ensure that a proper tensioning force is exerted on the third driving belt 332 during a transmission. Thus, it is possible to avoid a slippage of the third driving belt 332, or avoid derailment of the third driving belt 332 due to a tooth escape or tooth detachment. In this manner, the third driving belt 332 is driven by the second driving gear 32 to move, and the third transmission gear 331 is driven by the third driving belt 332 to rotate to drive the scraping sleeve 13 to rotate. Such a structure is simple and reliable.

In some embodiments of the present disclosure, as illustrated in FIG. 14, the transmission assembly also includes a transmission member 333 in a hollow ring shape extending in an axial direction of the scraping sleeve 13. The transmission member 333 has one end connected to the third transmission gear 331, and another end fixed relative to the scraping sleeve 13. In this manner, the transmission member 333 is driven by the third transmission gear 331 to rotate synchronously to drive the scraping sleeve 13 to rotate synchronously.

Here, the transmission member 333 having another end fixed relative to the scraping sleeve 13 means that the scraping sleeve 13 and the transmission member 333 may be fixedly connected to each other by welding, threaded connection, etc., or the transmission member 333 may be in a transmission connection with the scraping sleeve 13 by a gear engagement, etc., as long as the transmission member 333 is capable of driving the scraping sleeve 13 to rotate synchronously. The present disclosure is not limited in this regard. For example, the transmission member 333 may extend in a leftward-rightward direction, and has a right end connected to the third transmission gear 331 and a left end fixed to a right end of the scraping sleeve 13.

Figure 17:
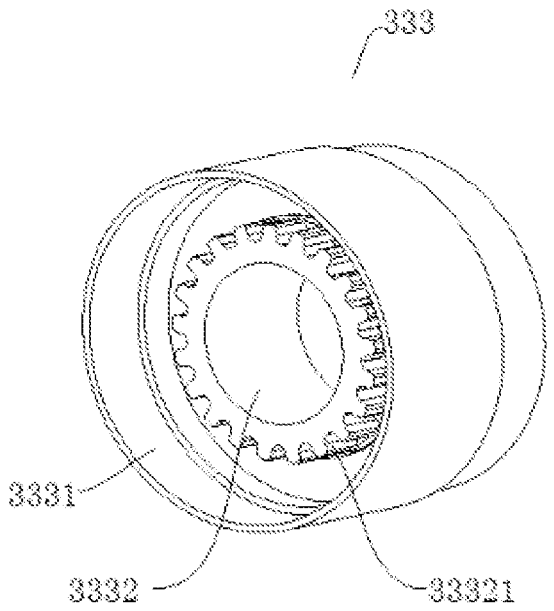
FIG. 17 is a perspective view of a transmission member according to an embodiment of the present disclosure.
Figure 18:
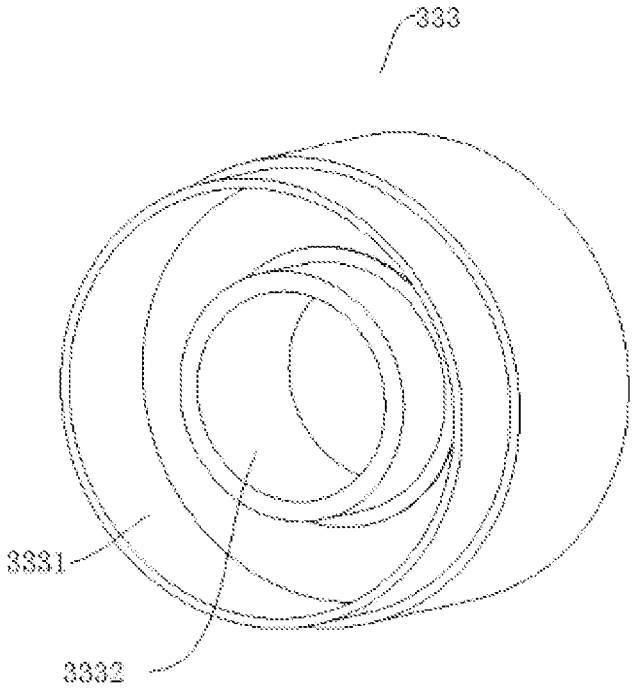
FIG. 18 is a perspective view of a transmission member according to an embodiment of the present disclosure from another view.

Further, as illustrated in FIG. 17 and FIG. 18, the transmission member 333 includes an outer ring plate 3331, an inner ring plate 3332, and a connection plate 3333.

In an embodiment, the outer ring plate 3331 is in a cylindric shape extending in the axial direction of the scraping sleeve 13. The outer ring plate 3331 has an axial end fixed to the third transmission gear 331 and another axial end fixed to the scraping sleeve 13. The inner ring plate 3332 is in a cylindric shape extending in the axial direction of the scraping sleeve 13 and is located at a radial inner side of the outer ring plate 3331. The connection plate 3333 is connected between an inner wall surface of the outer ring plate 3331 and an outer wall surface of the inner ring plate 3332. In this manner, the outer ring plate 3331 is driven by the third transmission gear 331 to rotate synchronously to drive the scraping sleeve 13 to rotate synchronously. In addition, mounting in such a manner is stable.

In an embodiment, each of the outer ring plate 3331 and the inner ring plate 3332 extends in the leftward-rightward direction. The third transmission gear 331 is sleeved over an outer peripheral wall of the outer ring plate 3331 at a right end thereof. The outer ring plate 3331 is sleeved over the outer peripheral wall of the scraping sleeve 13 at a left end thereof. The connection plate 3333 is in a circular shape. The connection plate 3333 has an outer peripheral wall fixed on an inner wall surface of the outer ring plate 3331, and an inner peripheral wall of fixed on an outer wall surface of the inner ring plate 3332.

Here, the outer ring plate 3331, the inner ring plate 3332, and the connection plate 3333 may be formed into one piece to realize a high degree of integration and a compact structure and to eliminate corresponding assembly steps. In this case, a cross section of the transmission member 333 in a vertical plane perpendicular to a forward-backward direction is substantially in a "工" shape. The outer ring plate 3331, the inner ring plate 3332, and the connection plate 3333 may also be separate members.

In some embodiments of the present disclosure, as illustrated in FIG. 14, the transmission assembly also includes a fourth transmission gear 334 fixedly connected to the roller brush body 11, and a fifth transmission gear 335 engaged with the fourth transmission gear 334 and fixed relative to the inner ring plate 3332.

In this manner, the inner ring plate 3332 is driven by the outer ring plate 3331 to rotate synchronously. The fifth transmission gear 335 is driven by the inner ring plate 3332 to rotate synchronously. The fourth transmission gear 334 is driven by the fifth transmission gear 335 to rotate. The roller brush body 11 is driven by the fourth transmission gear 334 to rotate synchronously. Therefore, the third transmission gear 331 is capable of driving both the scraping sleeve 13 and the roller brush body 11 to rotate.

Here, the fifth transmission gear 335 being fixed relative to the inner ring plate 3332 means that the fifth transmission gear 335 and the inner ring plate 3332 may be fixedly connected to each other by welding, threaded connections, etc., or the fifth transmission gear 335 may be in a transmission connection with the inner ring plate 3332 by a gear engagement, etc., or the fifth transmission gear 335 and the inner ring plate 3332 may be formed into one piece, as long as the inner ring plate 3332 is capable of driving the fifth transmission gear 335 to rotate synchronously. The present disclosure is not limited in this regard.

Figure 13:
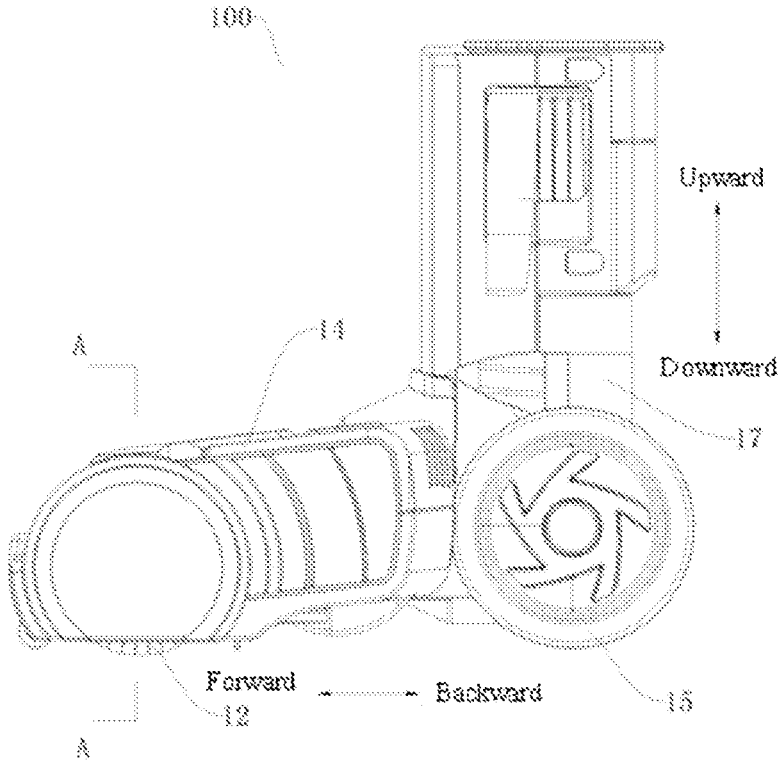
FIG. 13 is a schematic structural view of a vacuum cleaner according to an embodiment of the present disclosure from yet another view.

In an embodiment, as illustrated in FIG. 13, the fourth transmission gear 334 is in a cylindric shape extending in the axial direction of the roller brush body 11. The fourth transmission gear 334 has an engagement portion formed on an end thereof. The engagement portion is formed as an outer tooth. The roller brush body 11 is sleeved over a peripheral wall at the other end of the fourth transmission gear 334. Such a manner facilitates assembly of the roller brush body 11 with the fourth transmission gear 334.

Figure 11:
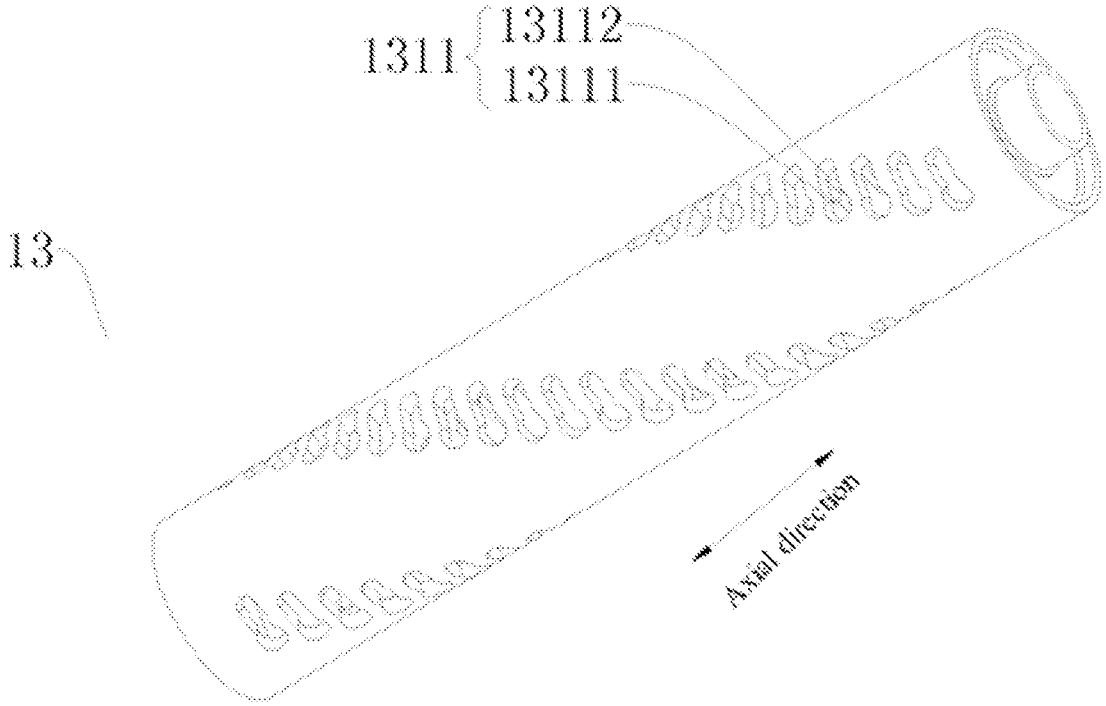
FIG. 11 is a schematic view of the scraping sleeve illustrated in FIG. 5 according to another embodiment.
Figure 12:
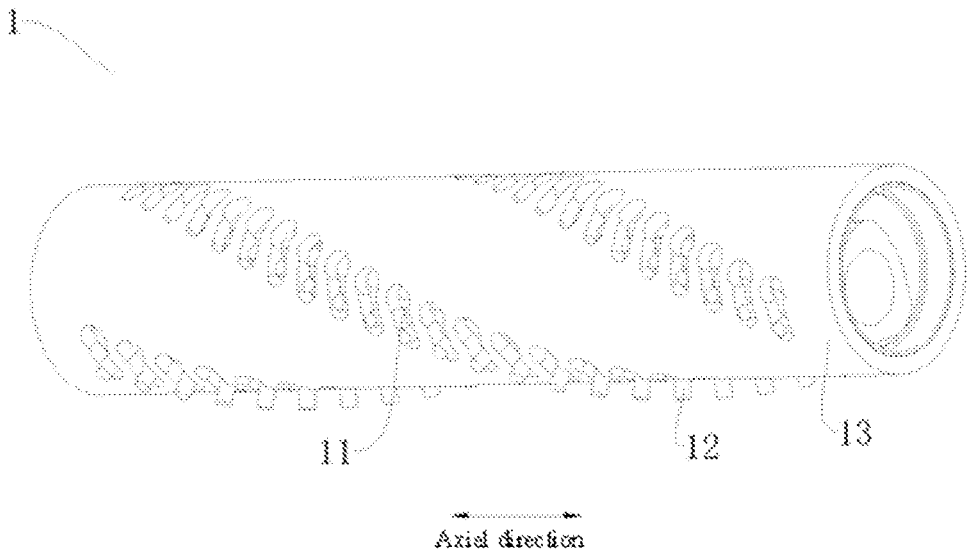
FIG. 12 is a schematic view of the scrubber brush assembly illustrated in FIG. 9 according to another embodiment.

Further, as illustrated in FIG. 11 and FIG. 12, the fifth transmission gear 335 has a first engagement portion 3351 formed thereon. The first engagement portion 3351 is formed as an inner tooth. The first engagement portion 3351 is engaged with the fourth transmission gear 334. In this manner, a stable transmission connection between the fifth transmission gear 335 and the fourth transmission gear 334 can be ensured.

Further, as illustrated in FIG. 11 and FIG. 12, the fifth transmission gear 335 also has a second engagement portion 3352 formed thereon. The second engagement portion 3352 is axially (e.g., in the leftward-rightward direction) spaced apart from the first engagement portion 3351 and formed as an inner tooth. The inner ring plate 3332 has a third engagement portion 33321 provided on the outer wall surface thereof and formed as an outer tooth. The second engagement portion 3352 is engaged with the third engagement portion 33321. In this manner, a relative fixation between the inner ring plate 3332 and the fifth transmission gear 335 is realized by a gear transmission, which makes fabrication and assembly of members more convenient and provides a more stable structure compared with other fixation methods.

Furthermore, the third transmission gear 331, the fourth transmission gear 334, the first engagement portion 3351, the second engagement portion 3352, and the third engagement portion 33321 have a same number of teeth.

Figure 7:
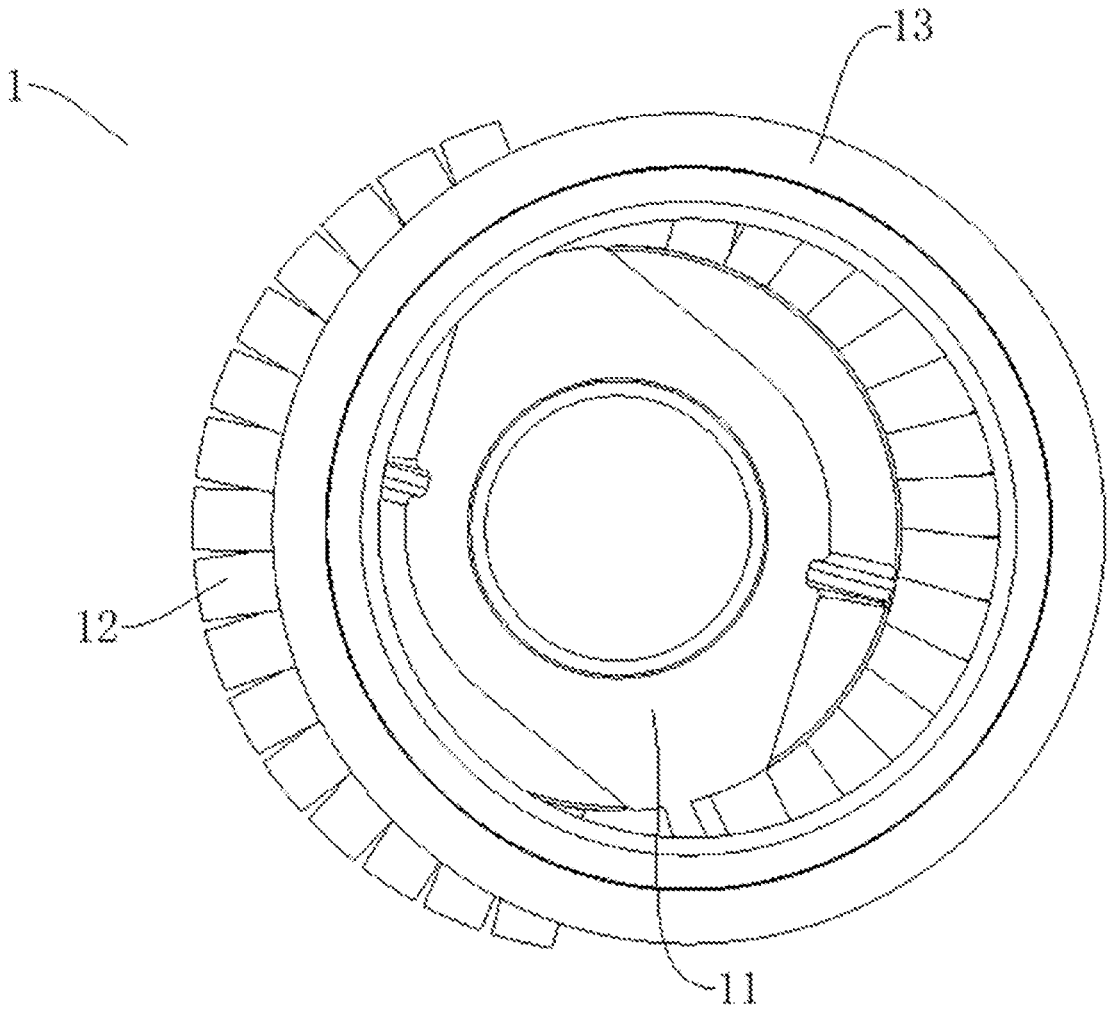
FIG. 7 is a side view of a scrubber brush assembly illustrated in FIG. 1.
Figure 8:
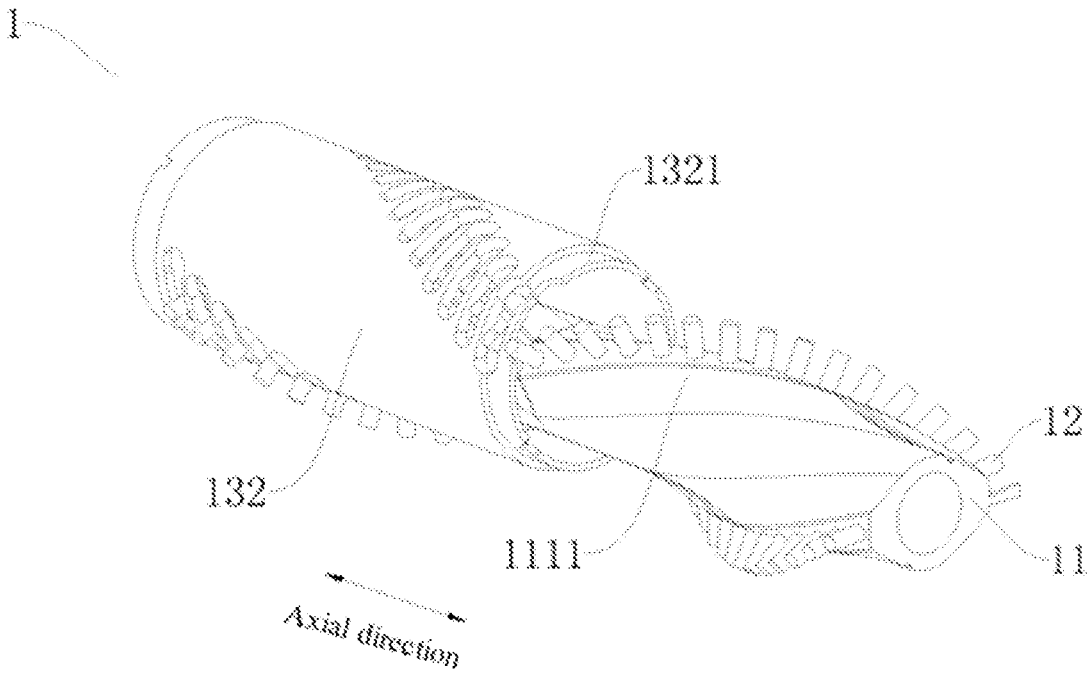
FIG. 8 is a schematic partial view of the scrubber brush assembly illustrated in FIG. 7.

As illustrated in FIG. 6 and FIG. 7, the third transmission gear 331 is driven by the driving belt to rotate. The scraping sleeve 13 is driven by the third transmission gear 331 to rotate synchronously. A process of realizing the rotation of the roller brush body 11 is described below. The inner ring plate 3332 is driven by the outer ring plate 3331 to rotate synchronously. The third engagement portion 33321 on the inner ring plate 3332 is brought into a transmission engagement with the second engagement portion 3352 to drive the fifth transmission gear 335 to rotate. The first engagement portion 3351 on the fifth transmission gear 335 is brought into a transmission engagement with the fourth transmission gear 334. The roller brush body 11 is driven by the fourth transmission gear 334 to rotate synchronously.

In this case, since the fourth transmission gear 334, the first engagement portion 3351, the second engagement portion 3352, and the third engagement portion 33321 have the same number of teeth, i.e., a ratio of a number of teeth of the second engagement portion 3352 to a number of teeth of the third engagement portion 33321 is identical to a ratio of a number of teeth of the fourth transmission gear 334 to a number of teeth of the first engagement portion 3351, the inner ring plate 3332, the fifth transmission gear 335, and the fourth transmission gear 334 have a same angular speed. In this manner, the third transmission gear 331 may have a same angular speed as the roller brush body 11. In addition, the scraping sleeve 13 has a same angular speed as the third transmission gear 331. Therefore, the angular speed of the roller brush body 11 is the same as that of the scraping sleeve 13. That is, the roller brush body 11 and the scraping sleeve 13 can rotate synchronously at the same angular speed. Such a manner ensures that the bristle 12 corresponds to the scraping sleeve hole 1311 in the circumferential direction. Further, it is ensured that the bristle 12 can be extended out of and retracted into the respective scraping sleeve hole 1311 in the radial direction of the scraping sleeve 13.

The applicants found through research that involute profiles of standard gears can be rolled against each other without relative sliding, which realizes minimal wear and increased efficiency. However, since the present disclosure needs to employ inner and outer gears having the same number of teeth, interference may occur at tips of teeth of standard gears when the standard gears are selected for the inner ring plate 3332, the fifth transmission gear 335, and the fourth transmission gear 334, which may result in abnormal operation of the gears. In one embodiment, modifying shapes of the teeth of the standard gears to avoid the interference is likely to generate a high wear rate and loud noises.

To this end, in some embodiments of the present disclosure, non-standard gears are selected for the inner ring plate 3332, the fifth transmission gear 335, and the fourth transmission gear 334. Such a manner can ensure that more teeth will be brought into contact with each other between the second engagement portion 3352 and the third engagement portion 33321 as well as between the fourth transmission gear 334 and the first engagement portion 3351, which can reduce a stress at each contact point, and lowers a wear rate of gears. Further, it is possible to prolong the service life of gears and attenuate the noises.

In a second aspect of the present disclosure, a vacuum cleaner 100 includes the scrubber brush assembly 1 in the first aspect of the present disclosure. Other configuration as well as operations of the vacuum cleaner 100 according to embodiments of the present disclosure, and thus details thereof will be omitted herein.

With the vacuum cleaner 100 according to the present disclosure, by providing the scrubber brush assembly 1 in the first aspect, the hairs attached to the bristle 12 can be cleaned automatically, which eliminates a need for manual cleaning and makes the vacuum cleaner more user-friendly, to improve the cleaning efficiency of the vacuum cleaner 100.

The vacuum cleaner 100 according to some embodiments of the present disclosure will be described below with reference to FIG. 1 to FIG. 21.

First Embodiment

According to the present disclosure, a vacuum cleaner 100 includes a scrubber brush assembly 1.

In an embodiment, as illustrated in FIG. 1, the scrubber brush assembly 1 includes a roller brush body 11, a scraping sleeve 13, a housing 14, a roller wheel 15, a driving device 164, and a dust suction cavity 17. Here, the roller brush body 11 is rotatable around a first rotation center line. The roller brush body 11 has a first protruding rib and a second protruding rib formed on an outer peripheral wall thereof. Each of the first protruding rib and the second protruding rib extends spirally in the axial direction of the roller brush body 11. The roller brush body 11 has a first bristle group and a second bristle group provided thereon. Each of the first bristle group and the second bristle group includes bristles 12. The first bristle group is disposed on the first protruding rib. The bristles 12 of the first bristle group is arranged at intervals in an extending direction of the first protruding rib. The second bristle group is disposed on the second protruding rib. The bristles 12 of the second bristle group is arranged at intervals in an extending direction of the second protruding rib. In addition, the roller brush body 11 includes a first roller brush body segment 111 and a second roller brush body segment 112 that are sequentially arranged in the axial direction. The protruding rib 1111 on the first roller brush body segment 111 has a helical direction opposite to a helical direction of the protruding rib 1111 on the second roller brush body segment 112. The protruding rib 1111 on the first roller brush body segment 111 is connected to the protruding rib 1111 on the second roller brush body segment 112.

The scraping sleeve 13 is rotatable around a second rotation center line and sleeved over the roller brush body 11. The scraping sleeve 13 may have a first scraping sleeve hole group and a second scraping sleeve hole group formed thereon. Each of the first scraping sleeve hole group and the second scraping sleeve hole group includes scraping sleeve holes 1311. The scraping sleeve holes 1311 of the first scraping hole group corresponds to the bristles 12 of the first bristle group in a one-to-one correspondence. The sleeve holes 1311 of the second scraping hole group corresponds to the bristles 12 of the second bristle group in a one-to-one correspondence. Each of the scraping sleeve holes 1311 is formed as an elongated slot extending in a circumferential direction of the scraping sleeve 13, and includes a first hole portion 13111 in a circular shape and a second hole portion 13112 connected to and extending away from the first hole portion 13111. A width of the second hole portion 13112 in the axial direction of the scraping sleeve 13 is smaller than a diameter of the first hole portion 13111. Accordingly, the scraping sleeve 13 may include a first scraping sleeve segment 131 sleeved over the first roller brush body segment 111 and a second scraping sleeve segment 132 sleeved over the second roller brush body segment 112. The first scraping sleeve segment 131 is detachably connected to the second scraping sleeve segment 132.

The driving device 16 is capable of being in a transmission connection with each of the roller brush body 11 and the scraping sleeve 13 to drive the roller brush body 11 to rotate around the first rotation center line and to drive the scraping sleeve 13 to rotate around the second rotation center line.

The housing 14 covers over the scrubber brush assembly 1 and the driving device 16. The housing 14 has a dust suction inlet 141 defined at a bottom thereof. The bristle 12 on the roller brush body 11 is adapted to be extended out of the dust suction inlet 141 for ground cleaning. The housing 14 also has a dust suction outlet 142 defined at a rear side thereof. A dust suction cavity 17 is defined at the rear side of the housing 14. A front end of the dust suction cavity 17 is formed as a connection port 171 that is capable of being connected to the dust suction outlet 142. The dust suction outlet 142 may directly faces the scrubber brush assembly 1. When the vacuum cleaner 100 is in operation, the dust and hairs attached to the brush assembly 1 can be sucked into the dust suction cavity 17 through the dust suction outlet 142.

Two roller wheels 15 may be provided and arranged side by side at a bottom of the vacuum cleaner 100 to facilitate a movement of the vacuum cleaner 100.

During the operation of the vacuum cleaner 100, when the bristle 12 on the roller brush body 11 and the scraping sleeve hole 1311 corresponding to the bristle 12 rotates to a position exactly opposite to the dust suction inlet 141, the bristle 12 can complete an extending stroke. In this case, the bristle 12 is capable of being extended out of the scraping sleeve hole 1311 by a longest length, which facilitates ground cleaning by the bristle 12. When the roller brush body 11 and a roller sleeve continue rotating, the bristle 12 begins to be retracted into the scraping sleeve hole 1311. When the bristle 12 and the scraping sleeve hole 1311 corresponding to the bristle 12 rotate to a position exactly opposite to the dust suction outlet 142, the bristle 12 can complete a retraction stroke. In this case, a free end of the bristle 12 can be located in the scraping sleeve hole 1311, and flush with an outer wall of the scraping sleeve 13 or slightly protrudes from the scraping sleeve hole 1311, which facilitates sucking debris or hairs scraped off by the scraping sleeve 13 from the bristle 12 into the dust suction cavity 17. Therefore, the above processes are repeated by the roller brush body 11 and the scraping sleeve 13 to improve grounding cleaning efficiency and cleaning performance of the vacuum cleaner 100 and realize automatically cleaning of the hairs attached to the roller brush body 11 to prevent hair blockage.

Second Embodiment

Figure 19:
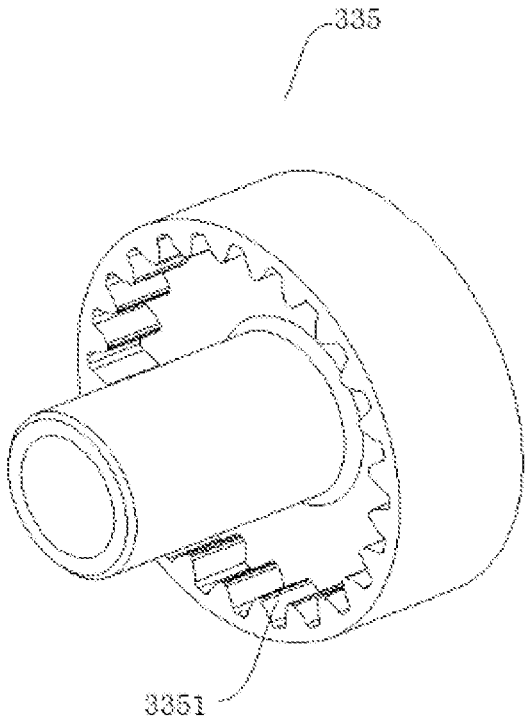
FIG. 19 is a perspective view of a fifth transmission gear according to an embodiment of the present disclosure.
Figure 20:
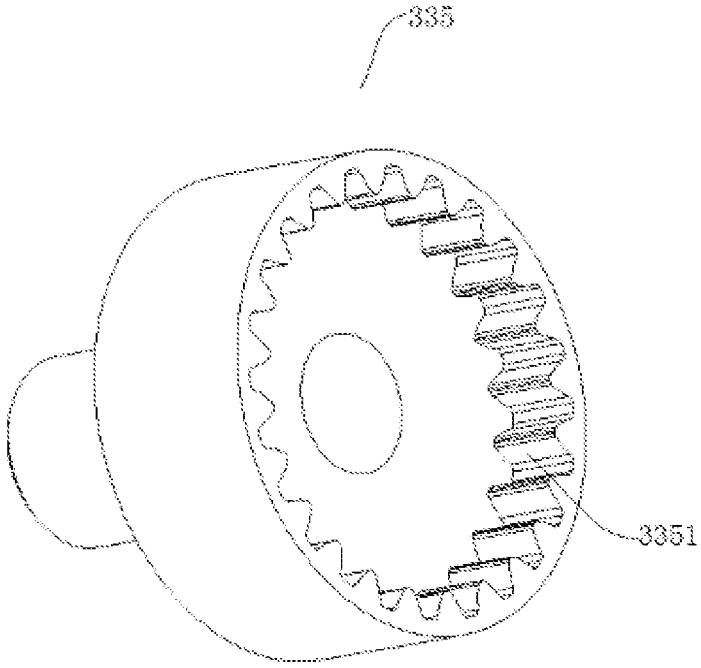
FIG. 20 is a perspective view of a fifth transmission gear according to an embodiment of the present disclosure from another view.
Figure 21:
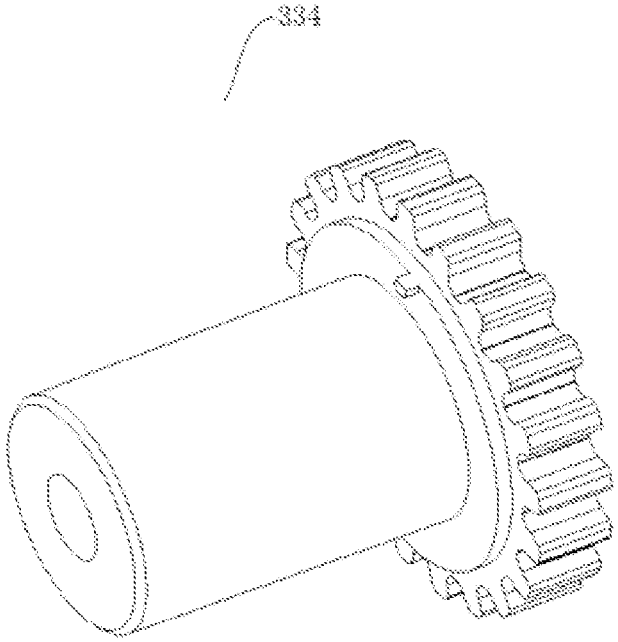
FIG. 21 is a perspective view of a fourth transmission gear according to an embodiment of the present disclosure.
Figure 22:
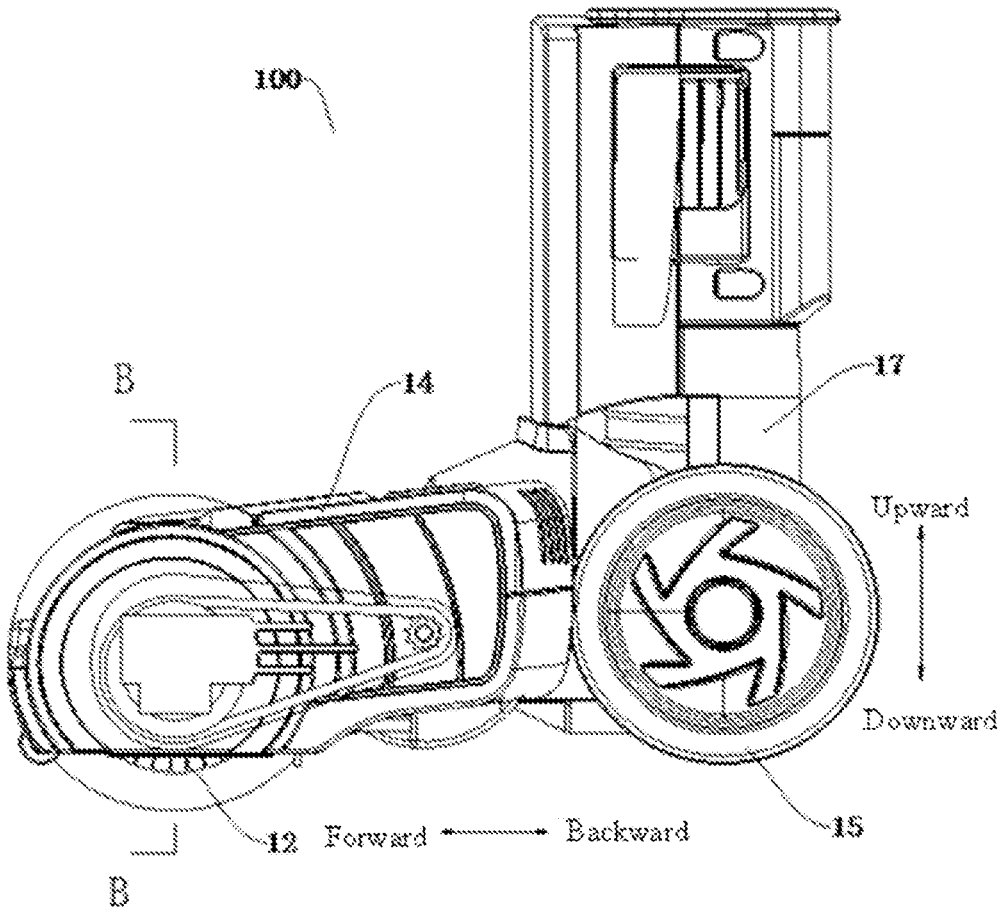
FIG. 22 is a schematic structural view of a vacuum cleaner according to an embodiment of the present disclosure.

As illustrated in FIG. 19 to FIG. 21, a structure according to this embodiment is substantially the same as that according to Embodiment 1. In the first embodiment and the second embodiment 2, the same members are denoted by same reference signs. The only differences between the first embodiment and the second embodiment are provided as below. In the first embodiment, the roller brush body 11 includes the first roller brush body segment 111 and the second roller brush body segment 112, and two protruding ribs 1111 and two bristle groups corresponding to the two protruding ribs 1111 are formed on roller brush body 11. The scraping sleeve 13 may include the first scraping sleeve segment 131 and the second scraping sleeve segment 132. Two scraping sleeve hole groups are formed on the scraping sleeve 13. However, in the second embodiment, the roller brush body 11 is formed as a one-piece body. Three protruding ribs 1111 and three bristle groups corresponding to the three protruding ribs 1111 are formed on the roller brush body 11. Accordingly, the scraping sleeve 13 is formed as a one-piece sleeve. Three scraping sleeve hole groups corresponding to the three bristle groups are formed on the scraping sleeve 13.

In the description of the present disclosure, it should be understood that the orientation or position relationship indicated by the terms "center", "upper", "lower", "vertical", "horizontal", "top", "bottom", "inner", "outer", "axial", "radial", "circumferential" etc., is based on the orientation or position relationship shown in the drawings, and is only for the convenience of describing the present disclosure and simplifying the description, rather than indicating or implying that the associated device or element must have a specific orientation, or be constructed and operated in a specific orientation, and therefore cannot be understood as a limitation of the present disclosure.

In addition, the terms "first" and "second" are only used for descriptive purposes, and cannot be understood as indicating or implying relative importance or implicitly indicating the number of indicated features. Therefore, the features associated with "first" and "second" may explicitly or implicitly include one or more features. In the description of the present disclosure, "a plurality of" means two or more, unless otherwise specifically defined.

In the present disclosure, unless otherwise clearly specified and limited, terms such as "installed", "mounted", "connected", "coupled", "fixed" and the like should be understood in a broad sense. For example, it may be a fixed connection or a detachable connection or connection as one piece; it may be a direct connection or an indirect connection through an intermediate; it may be an internal communication of two components or an interaction relationship between two components. The specific meaning of the above-mentioned terms in the present disclosure can be understood according to specific circumstances.

In the present disclosure, unless expressly stipulated and defined otherwise, the first feature "on", "over" or "under" the second feature may mean that the first feature is in direct contact with the second feature, or the first and second features are in indirect contact through an intermediate. Moreover, the first feature "above" the second feature may mean that the first feature is directly above or obliquely above the second feature, or simply mean that the level of the first feature is higher than that of the second feature. The first feature "below" the second feature may mean that the first feature is directly below or obliquely below the second feature, or simply mean that the level of the first feature is smaller than that of the second feature.

In the description of this specification, descriptions with reference to the terms "an embodiment", "some embodiments", "examples", "specific examples", or "some examples" etc. mean that specific features, structure, materials or characteristics described in conjunction with the embodiment or example are included in at least one embodiment or example of the present disclosure. In this specification, the schematic representations of the above terms do not necessarily refer to the same embodiment or example. Moreover, the described specific features, structures, materials or characteristics may be combined in any one or more embodiments or examples in a suitable manner.

What is claimed is:

1. A scrubber brush assembly, comprising:

a roller brush body rotatable around a first rotation center line extending in a horizontal direction and having a bristle provided thereon, the bristle extending in a radial direction of the roller brush body;

a scraping sleeve rotatable around a second rotation center line and sleeved over the roller brush body, the second rotation center line extending in the horizontal direction and being noncoincident with the first rotation center line, wherein the scraping sleeve has a scraping sleeve hole defined thereon and penetrating the scraping sleeve in a wall thickness direction of the scraping sleeve, an inside of the scraping sleeve hole being opposite to an outside of the bristle, and wherein the bristle is adapted to be extended out of or retracted into the scraping sleeve hole in the wall thickness direction of the scraping sleeve; and a housing having an accommodation space defined therein, an inner surface of the housing corresponding to the accommodation space being at least partially formed as a cylindrical surface extending in the horizontal direction, wherein:

the roller brush body and the scraping sleeve are disposed in the housing;

the first rotation center line of the roller brush body is eccentrically arranged with respect to a center axis of a circumferential wall of the cylindrical surface of the accommodation space;

the second rotation center line of the scraping sleeve is coincident with the center axis of the circumferential wall of the cylindrical surface of the accommodation space; and the bristle is adapted to be extended out of or retracted into the scraping sleeve hole in the wall thickness direction of the scraping sleeve when the roller brush body and the scraping sleeve rotate.

2. The scrubber brush assembly according to claim 1, wherein in the radial direction of the roller brush body, a distance between a free end of the bristle and the first rotation center line is equal to or greater than a maximum distance between the first rotation center line and an inner peripheral wall of the scraping sleeve.

3. The scrubber brush assembly according to claim 1, wherein the scraping sleeve hole comprises:

a first hole portion in a circular shape; and a second hole portion connected to and extending away from the first hole portion in a circumferential direction of the scraping sleeve, wherein a width of the second hole portion in an axial direction of the scraping sleeve is smaller than a diameter of the first hole portion.

4. The scrubber brush assembly according to claim 1, wherein:

the housing has a dust suction inlet and a dust suction outlet that are defined thereon and in communication with the accommodation space; and in a circumferential direction of the roller brush body, the bristle at a position corresponding to the dust suction inlet is capable of being extended out of the scraping sleeve hole by a longest length.

5. The scrubber brush assembly according to claim 1, further comprising a first driving device connected to the roller brush body and the scraping sleeve to drive the roller brush body and the scraping sleeve to rotate, wherein the bristle is adapted to be extended out of or retracted into the scraping sleeve hole in a radial direction of the scraping sleeve when the roller brush body and the scraping sleeve rotate.

6. The scrubber brush assembly according to claim 5, wherein the first driving device comprises:

a first driving motor having a first driving shaft;

a first driving gear coaxially fixed with the first driving shaft;

a first transmission assembly connected between the first driving gear and the scraping sleeve in a transmission manner; and a second transmission assembly connected between the first driving gear and the roller brush body in a transmission manner.

7. The scrubber brush assembly according to claim 6, wherein the first transmission assembly comprises:

a first transmission gear connected to the scraping sleeve; and a driving belt tensioned between the first driving gear and the first transmission gear.

8. The scrubber brush assembly according to claim 7, wherein the second transmission assembly comprises:

a second transmission gear connected to the roller brush body; and a second driving belt tensioned between the first driving gear and the second transmission gear.

9. The scrubber brush assembly according to claim 8, wherein the second transmission gear comprises:

an engagement ring plate in a cylindric shape extending axially, the engagement ring plate having a second transmission tooth portion formed on an outer surface thereof, the second transmission tooth portion being in a transmission engagement with the second driving belt;

a connection sleeve in a cylindric shape extending in an axial direction of the roller brush body, the connection sleeve being located on an inner side of the engagement ring plate, wherein an end of the connection sleeve facing towards the roller brush body is connected to the roller brush body; and a radial plate extending in a radial direction of the roller brush body and connected to each of the engagement ring plate and the connection sleeve.

10. The scrubber brush assembly according to claim 5, further comprising a second driving device connected to one of the roller brush body or the scraping sleeve, wherein:

the roller brush body and the scraping sleeve is in a transmission connection; and the bristle is configured to extend out of or retract into the scraping sleeve hole in a radial direction of the scraping sleeve when the roller brush body and the scraping sleeve rotate.

11. The scrubber brush assembly according to claim 10, wherein the second driving device comprises:

a second driving motor having a second driving shaft; and a transmission assembly connected between the second driving shaft and the scraping sleeve.

12. The scrubber brush assembly according to claim 11, wherein:

the second driving device further comprises a second driving gear coaxially fixed with the second driving shaft; and the transmission assembly comprises:

a third transmission gear connected to the scraping sleeve; and a third driving belt tensioned between the second driving gear and the third transmission gear.

13. The scrubber brush assembly according to claim 12, wherein the transmission assembly further comprises a transmission member in a hollow ring shape extending in an axial direction of the scraping sleeve, the transmission member having one end connected to the third transmission gear and another end fixed relative to the scraping sleeve.

14. The scrubber brush assembly according to claim 13, wherein the transmission member comprises:

an outer ring plate in a cylindric shape extending in the axial direction of the scraping sleeve, the outer ring plate having an axial end fixed to the third transmission gear and another axial end fixed to the scraping sleeve;

an inner ring plate in a cylindric shape extending in the axial direction of the scraping sleeve, the inner ring plate being located at a radial inner side of the outer ring plate; and a connection plate connected between an inner wall surface of the outer ring plate and an outer wall surface of the inner ring plate.

15. The scrubber brush assembly according to claim 14, wherein the transmission assembly further comprises:

a fourth transmission gear fixedly connected to the roller brush body; and a fifth transmission gear engaged with the fourth transmission gear and fixed relative to the inner ring plate.

16. The scrubber brush assembly according to claim 15, wherein the fifth transmission gear has a first engagement portion formed thereon, the first engagement portion being formed as an inner tooth and engaged with the fourth transmission gear.

17. The scrubber brush assembly according to claim 16, wherein:

the fifth transmission gear further has a second engagement portion formed thereon, the second engagement portion being axially spaced apart from the first engagement portion and formed as an inner tooth; and the inner ring plate has a third engagement portion provided on the outer wall surface thereof and engaged with the second engagement portion.

18. A vacuum cleaner, comprising:

a scrubber brush assembly, comprising:

a roller brush body rotatable around a first rotation center line extending in a horizontal direction and having a bristle provided thereon, the bristle extending in a radial direction of the roller brush body;

a scraping sleeve rotatable around a second rotation center line and sleeved over the roller brush body, the second rotation center line extending in the horizontal direction and being noncoincident with the first rotation center line, wherein the scraping sleeve has a scraping sleeve hole defined thereon and penetrating the scraping sleeve in a wall thickness direction of the scraping sleeve, an inside of the scraping sleeve hole being opposite to an outside of the bristle, and wherein the bristle is adapted to be extended out of or retracted into the scraping sleeving hole in the wall thickness direction of the scraping sleeve; and a housing having an accommodation space defined therein, an inner surface of the housing corresponding to the accommodation space being at least partially formed as a cylindrical surface extending in the horizontal direction, wherein:

the roller brush body and the scraping sleeve are disposed in the housing;

the first rotation center line of the roller brush body is eccentrically arranged with respect to a center axis of a circumferential wall of the cylindrical surface of the accommodation space;

the second rotation center line of the scraping sleeve is coincident with the center axis of the circumferential wall of the cylindrical surface of the accommodation space; and the bristle is adapted to be extended out of or retracted into the scraping sleeve hole in the wall thickness direction of the scraping sleeve when the roller brush body and the scraping sleeve rotate.

* * * * *